US011798366B2

(12) United States Patent
Chan et al.

(10) Patent No.: US 11,798,366 B2
(45) Date of Patent: Oct. 24, 2023

(54) ELECTRONIC GAMING SYSTEM AND METHOD FOR PROVIDING UPGRADEABLE SYMBOL AWARDS

(71) Applicant: Aristocrat Technologies Australia Pty Limited, North Ryde (AU)

(72) Inventors: Matthew Chan, Gordon (AU); Peter Wasielewski, Austin, TX (US); Amit Gupta, Haryana (IN)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 426 days.

(21) Appl. No.: 16/865,138

(22) Filed: May 1, 2020

(65) Prior Publication Data

US 2021/0049869 A1 Feb. 18, 2021

(30) Foreign Application Priority Data

Aug. 16, 2019 (AU) ..... 2019216700

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/34* (2013.01)

(58) Field of Classification Search
CPC ... G07F 17/3262; G07F 17/3213; G07F 17/34
USPC ..... 463/20
See application file for complete search history.

(56) References Cited

U.S. PATENT DOCUMENTS

| | | | |
|---|---|---|---|
| D644,240 | S | 8/2011 | Arnold |
| D649,974 | S | 12/2011 | Liu |
| D664,984 | S | 8/2012 | Lee |
| D673,168 | S | 12/2012 | Frijlink |
| D695,781 | S | 12/2013 | Edwards |
| D700,194 | S | 2/2014 | Kim |
| D705,242 | S | 5/2014 | Bohmfalk |
| D730,381 | S | 5/2015 | Zhong |
| D732,571 | S | 6/2015 | Yamashita |

(Continued)

OTHER PUBLICATIONS

Office Action dated Oct. 6, 2020 for U.S. Appl. No. 29/702,209 (pp. 1-13).

(Continued)

*Primary Examiner* — Jay Trent Liddle
*Assistant Examiner* — Ryan Hsu
(74) *Attorney, Agent, or Firm* — Armstrong Teasdale LLP

(57) ABSTRACT

An electronic gaming system includes at least one processor configured to provide a reel-based wagering game. In the game, a matrix of symbol positions is displayed, and during each spin of the reels, the processor determines whether at least one symbol displayed in the matrix is a target (or collectable) symbol. When at least one target symbol is displayed, the processor also determines whether a threshold number of such target symbols have been accumulated from the matrix by the player, and if so, the processor awards a plurality of free games, each of which is evaluated against an upgraded paytable. The upgraded paytable defines a plurality of upgraded awards for a variety of symbol combinations, at least some of which incorporate the target symbol. In some cases, a different (e.g., upgraded) version of the target symbol may be displayed during free games.

20 Claims, 23 Drawing Sheets

(56) References Cited

U.S. PATENT DOCUMENTS

| | | | |
|---|---|---|---|
| 9,221,342 | B2 | 12/2015 | Dehmann |
| D746,852 | S | 1/2016 | Zhou |
| D757,045 | S | 5/2016 | Sun |
| D757,065 | S | 5/2016 | Jeon |
| D757,791 | S | 5/2016 | Van Os |
| D759,698 | S | 6/2016 | Kirsch |
| D760,732 | S | 7/2016 | Sakai |
| D763,885 | S | 8/2016 | Liu |
| D766,914 | S | 9/2016 | Talala |
| D769,297 | S | 10/2016 | Jewitt |
| D769,303 | S | 10/2016 | Rodriguez |
| D770,521 | S | 11/2016 | Lee |
| D772,278 | S | 11/2016 | Chaudhri |
| D794,657 | S | 8/2017 | Sung |
| D798,885 | S | 10/2017 | Saito |
| D812,641 | S | 3/2018 | Walkin |
| D814,491 | S | 4/2018 | Tuson |
| D820,868 | S | 6/2018 | Lee |
| D828,384 | S | 9/2018 | Nilsson |
| D828,386 | S | 9/2018 | Nilsson |
| D832,295 | S | 10/2018 | Chung |
| D832,884 | S | 11/2018 | Clediere |
| D840,429 | S | 2/2019 | Kroon |
| D848,458 | S | 5/2019 | Rocha |
| D849,026 | S | 5/2019 | Anzures |
| D850,464 | S | 6/2019 | Satterlie |
| D851,674 | S | 6/2019 | Bass |
| D858,569 | S | 9/2019 | Penacho |
| D859,428 | S | 9/2019 | Uchida |
| D859,449 | S | 9/2019 | Souza Dos Santos |
| D859,464 | S | 9/2019 | Seo |
| D861,716 | S | 10/2019 | Penacho |
| D872,098 | S | 1/2020 | Chaudhri |
| D872,740 | S | 1/2020 | Ternoey |
| D873,843 | S | 1/2020 | Jang |
| D875,130 | S | 2/2020 | Lee |
| D875,131 | S | 2/2020 | Lee |
| D875,753 | S | 2/2020 | D'Costa |
| D875,762 | S | 2/2020 | Evans |
| 10,560,410 | B2 | 2/2020 | Guthery |
| D877,759 | S | 3/2020 | Nishizawa |
| D879,817 | S | 3/2020 | Evans |
| D884,729 | S | 5/2020 | Souza Dos Santos |
| D886,850 | S | 6/2020 | Kim |
| D888,072 | S | 6/2020 | Klein |
| D888,733 | S | 6/2020 | Fong |
| D900,127 | S | 10/2020 | Visser |
| D900,859 | S | 11/2020 | Satterlie |
| D902,943 | S | 11/2020 | Hill |
| 10,848,661 | B2 | 11/2020 | Brown |
| D904,452 | S | 12/2020 | Kroon |
| D910,655 | S | 2/2021 | Matthewman |
| D921,013 | S | 6/2021 | Boese |
| D925,598 | S | 7/2021 | Sanborn |
| 11,106,986 | B2 | 8/2021 | Doddi |
| D934,284 | S | 10/2021 | Jiang |
| D938,972 | S | 12/2021 | Boese |
| D939,541 | S | 12/2021 | Marks |
| D940,750 | S | 1/2022 | Kroon |
| D944,284 | S | 2/2022 | Metzger et al. |
| D944,289 | S | 2/2022 | Cordova et al. |
| D947,869 | S | 4/2022 | Yajurvedi |
| D954,084 | S | 6/2022 | Broughton et al. |
| D956,060 | S | 6/2022 | Wasielewski |
| D960,899 | S | 8/2022 | Paul |
| D962,253 | S | 8/2022 | Kim |
| D965,016 | S | 9/2022 | Bang |
| D965,023 | S | 9/2022 | Visser |
| D965,024 | S | 9/2022 | Visser |
| D967,148 | S | 10/2022 | Boese |
| D973,702 | S | 12/2022 | Shim |
| D974,367 | S | 1/2023 | Coffee |
| D978,166 | S | 2/2023 | Jiang |
| D978,174 | S | 2/2023 | Marks |
| 2006/0184966 | A1 | 8/2006 | Hunleth |
| 2008/0039191 | A1* | 2/2008 | Cuddy ..... G07F 17/32 463/25 |
| 2008/0155475 | A1 | 6/2008 | Duhig |
| 2009/0042652 | A1* | 2/2009 | Baerlocher ..... G07F 17/34 463/20 |
| 2009/0271723 | A1 | 10/2009 | Matsushima |
| 2010/0029381 | A1* | 2/2010 | Vancura ..... G07F 17/3244 463/30 |
| 2017/0024957 | A1* | 1/2017 | Boese ..... G07F 17/3213 |
| 2017/0092070 | A1* | 3/2017 | Marston ..... G07F 17/3267 |
| 2018/0218573 | A1* | 8/2018 | Pettie ..... G07F 17/3213 |
| 2019/0340886 | A1* | 11/2019 | Humphrey ..... G07F 17/3293 |
| 2020/0342715 | A1* | 10/2020 | Hiten ..... G07F 17/34 |
| 2021/0049869 | A1 | 2/2021 | Chan |
| 2021/0118259 | A1 | 4/2021 | Mizzi |
| 2022/0189240 | A1 | 6/2022 | Mizzi |

OTHER PUBLICATIONS

GLTableCollectionView, maniacdev.com [online], published on Jan. 14, 2017, [retrieved on Sep. 30, 2020], retrieved from the Internet < URL: https://maniacdev.com/2017/01/gltablecollectionview-a-swift-component-scrollingsliding-content-like-in-the-app-store> (Year: 2017).

How to Create a Netflix Carousel by Using CSS, YouTube [online], published on Feb. 6, 2019, [retrieved on Sep. 30, 2020], retrieved from the Internet <URL: https://www.youtube.com/watch?v=maNqKlfk3ds> (Year: 2019).

Office Action dated Apr. 27, 2021 for U.S. Appl. No. 29/702,209 (pp. 1-12).

Office Action dated Nov. 4, 2021 for U.S. Appl. No. 29/702,209 (pp. 1-8).

Query UI (3.3.1) Range Slider Values Display in asp.net Textbox, by Haritha Computers & Technology, YouTube [online],published on Mar. 24, 2018, [retrieved on Nov. 1, 2021], retrieved from the Internet <URL https://www.youtube.com/watch?v=qlQMs8TwG94> (Year: 2018).

Notice of Allowance dated Feb. 23, 2022 for U.S. Appl. No. 29/702,209 (pp. 1-8).

Office Action dated Jun. 23, 2022 for U.S. Appl. No. 29/864,261 (pp. 1-16).

Notice of Allowance dated Mar. 23, 2023 for U.S. Appl. No. 29/864,261 (pp. 1-9).

* cited by examiner

300

| | Reel strip position | Reel 1 (341) | Reel 2 (342) | Reel 3 (343) | Reel 4 (344) | Reel 5 (345) |
|---|---|---|---|---|---|---|
| 301 | 1 | Pic 1 | 10 | Pic 3 | Q | Pic 1 |
| 302 | 2 | K | Q | K | A | 10 |
| 303 | 3 | J | K | 10 | 10 | A |
| 304 | 4 | Scat | Pic 1 | Pic 2 | Scat | Wild |
| 305 | 5 | Q | A | Q | Pic 2 | Pic 2 |
| 306 | 6 | 10 | Pic 2 | K | J | A |
| 307 | 7 | Q | Pic 4 | K | Pic 1 | Q |
| 308 | 8 | Pic 2 | J | Wild | K | Pic 3 |
| 309 | 9 | A | Q | 10 | Q | 9 |
| 310 | 10 | 9 | A | Pic 1 | K | J |
| 311 | 11 | Pic 2 | Pic 3 | 9 | Pic 4 | A |
| 312 | 12 | 10 | 9 | Pic 3 | Pic 1 | K |
| 313 | 13 | Pic 1 | K | A | Q | K |
| 314 | 14 | Pic 3 | 9 | Q | Pic 4 | Pic 4 |
| 315 | 15 | K | Scat | J | Pic 2 | 9 |
| 316 | 16 | K | 10 | 10 | 9 | Scat |
| 317 | 17 | J | Wild | 10 | A | K |
| 318 | 18 | Pic 4 | Pic 2 | Scat | A | Pic 1 |
| 319 | 19 | Pic 4 | Q | Pic 2 | 10 | Pic 1 |
| 320 | 20 | Pic 1 | Q | J | K | 10 |
| 321 | 21 | 10 | Pic 3 | Pic 3 | Pic 3 | K |
| 322 | 22 | J | J | Pic 4 | Pic 3 | Pic 2 |
| 323 | 23 | Pic 3 | K | K | 10 | Q |
| 324 | 24 | 9 | 9 | 10 | J | K |
| 325 | 25 | Pic 4 | Pic 3 | 9 | Pic 1 | Pic 3 |
| 326 | 26 | A | Pic 4 | Pic 3 | 9 | Pic 4 |
| 327 | 27 | 10 | Scat | Q | 10 | Pic 4 |
| 328 | 28 | Pic 4 | K | Pic 2 | Wild | 10 |
| 329 | 29 | 9 | 10 | J | Q | Pic 2 |
| 330 | 30 | Q | Q | Pic 4 | K | J |

354 351 352 353 331

FIG. 3

ELECTRONIC GAMING SYSTEM AND METHOD FOR PROVIDING UPGRADEABLE SYMBOL AWARDS

CROSS REFERENCE TO RELATED APPLICATIONS

This application claims priority to Australian Patent Application Serial No. 2019216700, filed Aug. 16, 2019 and entitled GAMING DEVICE WITH UPGRADEABLE SYMBOL AWARDS, which is incorporated by reference herein in its entirety.

FIELD

The present application relates to a gaming device and a method of operating a gaming device with upgradeable symbol awards.

BACKGROUND

Electronic gaming machines ("EGMs") or gaming devices provide a variety of wagering games such as slot games, video poker games, video blackjack games, roulette games, video bingo games, keno games, and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out".

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random

BRIEF DESCRIPTION

There are disclosed embodiments of a gaming device, a system and a method of operating a gaming device with collectable symbols that are collected when a collection condition is satisfied. The gaming device stores data defining how many collectable symbols have been collected in prior games. Once a threshold number of first collectable symbols are collected, upgraded pays are awarded for the first collectable symbol and a second collectable symbol becomes collectable.

There are also disclosed embodiments of a gaming device, a system and a method of operating a gaming device which provide a user interface for displaying progress towards collecting the collectable symbols. The user interface transitions between a first progress graphic which shows progress towards collecting a target number of an individual collectable symbol and a second progress graphic that shows progress towards collecting all the collectable symbols.

In an embodiment, there is provided a gaming device comprising a display, a processor, and a memory storing (a) reel data defining a plurality of reel strips, the reel strips comprising a plurality of symbols including a first collectable symbol, (b) award data defining winning combinations and awards for each winning combination of symbols, wherein the award data defines at least one winning combination featuring the first collectable symbol and base and upgraded awards for the, or each, winning combination featuring the first collectable symbol, (c) current game state data comprising data indicative of whether collection of first collectable symbols in prior game play has reached a threshold and, at least where the threshold has not been reached, a current number of collected first collectable symbols, and (d) instructions. When the instructions are executed by the processor, they cause the processor to receive a player selection of a plurality of available player selections, generate a game outcome by selecting symbols from the plurality of reel strips responsive to receipt of the selection and controlling the display to display the selected symbols in a plurality of columns of symbol positions, update the current game state data to reflect any first collectable symbols in the selected symbols that satisfies a collection condition, evaluate the game outcome for winning combinations of symbols, and make one or more awards upon the game outcome including one or more winning combinations including by, upon the one or more winning combinations comprising the winning combination featuring the first collectable symbol, making the base award if the number collected first collectable symbols has not reached the threshold and making the upgraded award if the threshold has been reached.

Another embodiment provides a method of operating a gaming device, the gaming device comprising a display and a memory storing (a) reel data defining a plurality of reel strips, the reel strips comprising a plurality of symbols including a first collectable symbol, (b) award data defining winning combinations and awards for each winning combination of symbols, wherein the award data defines at least one winning combination featuring the first collectable symbol and base and upgraded awards for the, or each, winning combination featuring the first collectable symbol, (c) current game state data comprising data indicative of whether collection of first collectable symbols in prior game play has reached a threshold and, at least where the threshold has not been reached, a current number of collected first collectable symbols. The method comprises receiving a player selection of a plurality of available player selections, generating a game outcome by selecting symbols from the plurality of reel strips responsive to receipt of the player selection and controlling the display to display the selected symbols in a plurality of columns of symbol positions, updating the current game state data to reflect any first collectable symbols in the selected symbols that satisfies a collection condition, evaluating the game outcome for winning combinations of symbols, and making one or more awards upon the game outcome including one or more winning combinations including by, upon the one or more winning combinations comprising the winning combination featuring the first collectable symbol, making the base award if the number collected first collectable symbols has not reached the threshold and making the upgraded award if the threshold has been reached.

Another embodiment provides a system comprising one or more processors, and at least one memory storing (a) reel data defining a plurality of reel strips, the reel strips comprising a plurality of symbols including a first collectable symbol, (b) award data defining winning combinations and awards for each winning combination of symbols, wherein the award data defines at least one winning combination featuring the first collectable symbol and base and upgraded awards for the, or each, winning combination featuring the first collectable symbol, (c) current game state data comprising data indicative of whether collection of first collectable symbols in prior game play has reached a threshold and, at least where the threshold has not been reached, a current number of collected first collectable symbols, and (d) instructions. When the instructions are executed by the one or more processors, they cause the one or more processors to receive a player selection of a plurality of available player selections, generate a game outcome by selecting symbols for display on a display in a plurality of columns of symbol positions from the plurality of reel strips responsive to receipt of the player selection, update the current game state data to reflect any first collectable symbols in the selected symbols that satisfies a collection condition, evaluate the game outcome for winning combinations of symbols, and make one or more awards upon the game outcome including one or more winning combinations including by, upon the one or more winning combinations comprising the winning combination featuring the first collectable symbol, making the base award if the number collected first collectable symbols has not reached the threshold and making the upgraded award if the threshold has been reached.

Another embodiment provides a gaming device comprising a display, a processor, and a memory storing instructions, wherein when the instructions are executed by the processor, they cause the processor to control a display to display a user interface for conveying progress of a game to a player of the game. The user interface comprises a first area for displaying game outcomes of a spinning reel game from which symbols can be collected to trigger a further game event, wherein display of each game outcome comprises display of the selected symbols of the game, and a second area, proximate the first area, the second area configured to transition, responsive to one or more change conditions being met, between a first progress graphic having an indicator indicating a current state of collection towards a target collection goal of an individual symbol of a group of symbols, and a second progress graphic having an indicator indicating a current state of collection towards a target collection goal of the group of symbols.

Another embodiment provides a method of operating a gaming device comprising a display, the method comprising controlling a display to display a user interface for conveying progress of a game to a player of the game. The user interface comprises a first area for displaying game outcomes of a spinning reel game from which symbols can be collected to trigger a further game event, wherein display of each game outcome comprises display of the selected symbols of the game, and a second area, proximate the first area, the second area configured to transition, responsive to one or more change conditions being met, between a first progress graphic having an indicator indicating a current state of collection towards a target collection goal of an individual symbol of a group of symbols, and a second progress graphic having an indicator indicating a current state of collection towards a target collection goal of the group of symbols.

Another embodiment provides a system comprising one or more processors, and memory storing instructions. When the instructions are executed by the one or more processors, they cause the one or more processors to cause a display to display a user interface for conveying progress of a game to a player of the game. The user interface comprises a first area for displaying game outcomes of a spinning reel game from which symbols can be collected to trigger a further game event, wherein display of each game outcome comprises display of the selected symbols of the game, and a second area, proximate the first area, the second area configured to transition, responsive to one or more change conditions being met, between a first progress graphic having an indicator indicating a current state of collection towards a target collection goal of an individual symbol of a group of symbols, and a second progress graphic having an indicator indicating a current state of collection towards a target collection goal of the group of symbols.

In some embodiments, an electronic gaming system includes a display device, a memory, and at least one processor configured to execute instructions stored in the memory, which when executed, cause the at least one processor to at least initiate a game session of a wagering game in response to a wager input received from a player of the wagering game. The instructions may also cause the at least one processor to control the display device to display a plurality of symbols in a matrix of symbol positions, where the matrix includes a plurality of rows of symbol positions and a plurality of columns of symbol positions. In at least some embodiments, the instructions may also cause the at least one processor to determine whether at least one symbol displayed in the matrix is an instance of a first collectable symbol associated with a first paytable, and in response to the instance of the first collectable symbol being displayed in the matrix, determine whether a threshold number of instances of the first collectable symbol have been accumulated by the player during the game session. If the threshold number of instances have been accumulated, the instructions may also cause the at least one processor to i) award a first plurality of free games, where each free game is associated with a combination of symbols defining a free game outcome, and ii) evaluate each free game outcome using an upgraded paytable, where the upgraded paytable defines at least one upgraded award for at least one winning symbol combination that includes the first collectable symbol. The upgraded award is, in at least some embodiments, greater than a base game award defined by the first paytable for the same at least one winning symbol combination.

BRIEF DESCRIPTION OF THE DRAWINGS

FIG. 3 illustrates an example reel strip layout.

DETAILED DESCRIPTION

Figure 1:
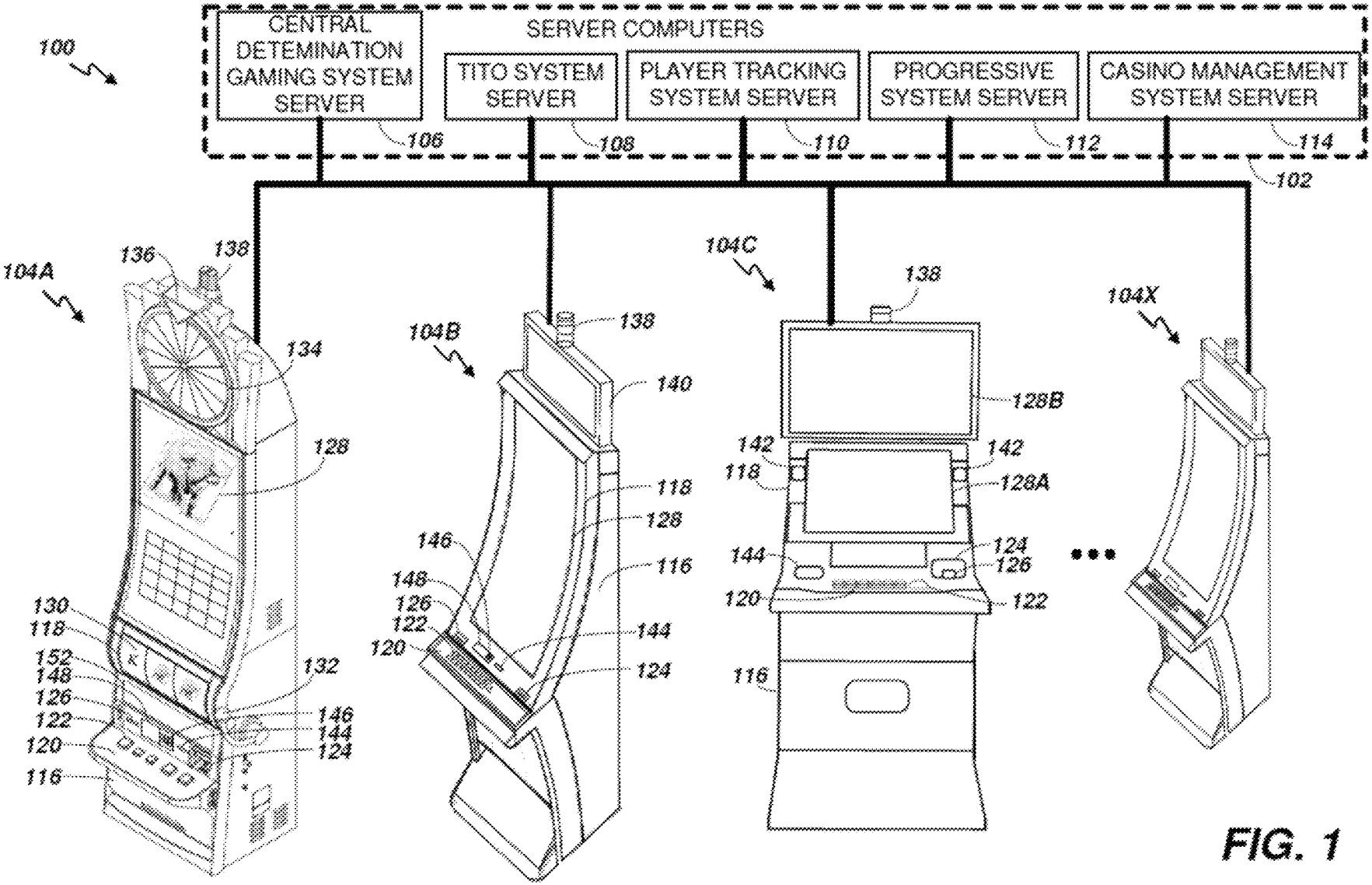
FIG. 1 is an exemplary diagram showing several EGMs networked with various gaming related servers.

Innovations are described for an electronic gaming device that includes a base game, such as a reel game with spinning reels of symbols, and a plurality of feature games. The feature games can be triggered by outcomes in the base game. For example, in at least some embodiments, during each spin of the reels of the base game, a processor may determine whether at least one symbol displayed from the reels is a target (or collectable) symbol. When at least one target symbol is displayed, the processor also determines whether a threshold number of such target symbols have been accumulated or collected by the player (e.g., over the course of multiple spins), and if so, the processor may award a plurality of feature games, each of which may be evaluated against an upgraded paytable and/or which may otherwise payout differently from the base game.

In various embodiments, the upgraded paytable defines a plurality of upgraded awards for a variety of symbol combinations, at least some of which incorporate the target symbol collected during the base game. In some cases, a different (e.g., upgraded) version of the target symbol may be displayed during the awarded plurality of feature games to provide a visual indication that occurrences of the target symbol during the feature games may represent upgraded awards as defined by the upgraded paytable applied during the feature games.

Further, in at least some embodiments, gameplay may progress in rounds or stages. For example, a player may attempt to collect a threshold number of a first target symbol at the beginning of the base game. In response to collection of threshold number of the first target symbol, a first feature game associated with a first upgraded paytable may be provided to the player. Following completion of the first feature game, the player may attempt to collect a threshold number of a second target symbol, different from the first target symbol, which may result in a second feature game having a second upgraded paytable, and so on, through a series of different target symbols, each associated with different upgraded paytables during respective feature games.

These and other features, as described herein, may facilitate a variety of technical improvements, such as, for example, extending player time on EGMs, creating new EGM functionality (e.g., the addition of variety of new staged gameplay), and/or improving the EGM's user interface to add or enhance understandability of player investment or perceived player equity in the game while complying with regulations. For example, the EGM's user interface is able to present achievement investment to players. As players advance through the completion of the game from one feature round to subsequent feature rounds, where subsequent feature rounds may not, in at least some embodiments, become available or "unlock" until previous feature rounds have been successfully completed. In addition, as described herein, during each of the multiple feature rounds, the use of a plurality of upgraded paytables to determine feature game awards may provide a build-up to increasing levels of game awards and result in new or improved EGM functionality, such as a new player interface and game presentation, as gameplay progresses through stages toward a penultimate feature game (e.g., a Frenzy feature game, as described herein).

In addition, in at least some embodiments, the addition of one or more upgraded paytables creates and facilitates new EGM functionality, including the new staged gameplay and new player interface and game presentation, as described herein. For example, incorporation of upgraded paytables results in a technical improvement to the functioning of the EGMs described herein, in that an appropriate upgraded paytable may be selectively applied (and a previous upgraded paytable replaced) across different feature rounds.

FIG. 1 illustrates several different models of EGMs which may be networked to various gaming related servers. The present disclosure can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.).

In some examples, EGMs may be equipped with a game state retention and continuation facility. For example, where the EGM is configured to issue a token, such as a readable ticket that has data thereon corresponding to a current game state. Alternatively, to allow game state retention and game continuation at a venue, a venue operator may employ a player tracking system that utilize player-specific trackers (e.g., magnetic stripe cards) to distinguish one player or player account from another. For example, a person having a game at one machine at the venue may be allowed to retain the state of the game against the person's tracker (e.g., via a magnetic card reader), with the retained state stored at the venue's electronic storage. Further, the person may be allowed to later continue the game at the same or another machine at the venue upon presentation of the player's tracker (e.g., via a magnetic card reader), with the retained state retrieved from the venue's electronic storage. This arrangement permits game state retention and continuation within the same venue.

A game is generally related to software, programs, or machine instructions that can be read or implemented by a gaming machine, configurable to receive input from a player (e.g. any one or more of a wager, a button activation, and icon selection) and produce output (e.g., any one or more of a displayed outcome, sound, and credit awards) which is at least in part controlled by a game processor 204. A game can be understood as including one or more game events which occur during the game. Each completed occurrence of a game event changes the game state of the game. These game states can be saved in a database as the "check-points" of the game in order to allow continuation of the game from a retained game state. This facility allows the game to be conducted in more than one game sessions, such as a first game session concluded with a first game state and a second game session commenced with the first game state. A game session is a largely uninterrupted period of gaming, for example started and completed by logging in and out of a player-tracking system, respectively. Each game session is associated with one or more game events. Consecutive game sessions are separated by a non-gaming period.

A game event may be associated with a non-metamorphic element (that is with an element specific to an individual game), such as a wagered spin of displayed reels (e.g., virtual or real) in a base game, or a free spin of displayed reels in a feature game. In the context of Class III gaming, at least some game events such as the reel spinning events involve random processes, with the duration of each of these game events generally quite short, for example commencing when a player places a wager, and completing when the player receives an outcome for that wager such that the player is required to place another wager to continue progress of the game. Each such game event may include awarding of any outcome responsive to a reel spin. An outcome may include an increase and/or a decrease of available game credits, and/or an award of a number of free reel spins. For example, a wagered spin may result in an increase in 100 game credits, as well as an award of 5 free spins. Responsive to a wagered spin, the game state includes game variables such as the resulting game credits as well as the available free spins. Responsive to a specific free spin, the game state includes game variables such as the resulting game credits following this free spin and a remaining number of available free spins.

In embodiments described below of a game involving spinning and stopping of rotatable reels (be it actual or simulated), a game variable includes collected symbols and may also include a last displayed outcome of the stopped reels and other graphical elements displayed when the game state was retained.

Multiple game events may occur in a non-time-overlapping manner, such as consecutive wagered spins of the displayed reels, where each spin completes before another spin commences.

Providing a facility to save game states is intended primarily to allow metamorphic game elements to be carried with the player who triggered/activated them rather than staying with the gaming machine on which they were triggered/activated as well as to allow a player to play a game over as many game sessions as desired.

In an example, an EGM may be configured to output a game state in an electronic form (e.g., an encrypted code defining the game state to be stored in the player tracking database sent to a designated email address or mobile phone number). In another example, an EGM may output a game state in a form, such as an optically readable code, capturable by a user device such as a smartphone, a tablet, or mobile computing device. In an example, a dedicated software program or an "app" (e.g., an iOS® app or an Android® app) may be installed on a user device to save a game state. Conversely, an EGM may be configured to receive an input of the code, e.g. by retrieving it from the database, receiving a code input by a user, reading an optically readable code and re-establishing the game state within the gaming machine so that the player can continue to play the game.

In an example, the EGM is configured to save the game state responsive to activation of a "save game" function, for example by pressing of a button or selection of an icon, on the EGM. Conversely, the player may continue the game by activating a "load game" function, for example by pressing of a button or selection of an icon.

The gaming devices 104A-104X may alternatively be portable and/or remote gaming devices such as, but not limited to, a smart phone, a tablet, a laptop, or a game console. In such examples, game states can be saved on a server computer. In some examples portable devices can be linked to specific players and their unique identifiers used to distinguish between players and assist with storing/retrieving player-specific game states. In some examples, identification mechanisms (e.g., password/biometric) deployed in those devices can be used as part of the game state retrieval process. E.g., a fingerprint authorization can be used to retrieve a game state.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like. In online embodiments, server computers 102 can be used to store player-specific game states for retrieval, and data networks are used to transfer game states to and from the server computer for storage and retrieval, so that a player using a remote gaming device is able to resume from where a game was last played.

In some embodiments, server computers 102 may not be necessary and/or preferred. For example, the present disclosure may, in one or more embodiments, be practiced on a stand-alone gaming device such as gaming device 104A, gaming device 104B, or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main cabinet 116. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming device 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in gaming device 104A (e.g., an EGM). In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, paytables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
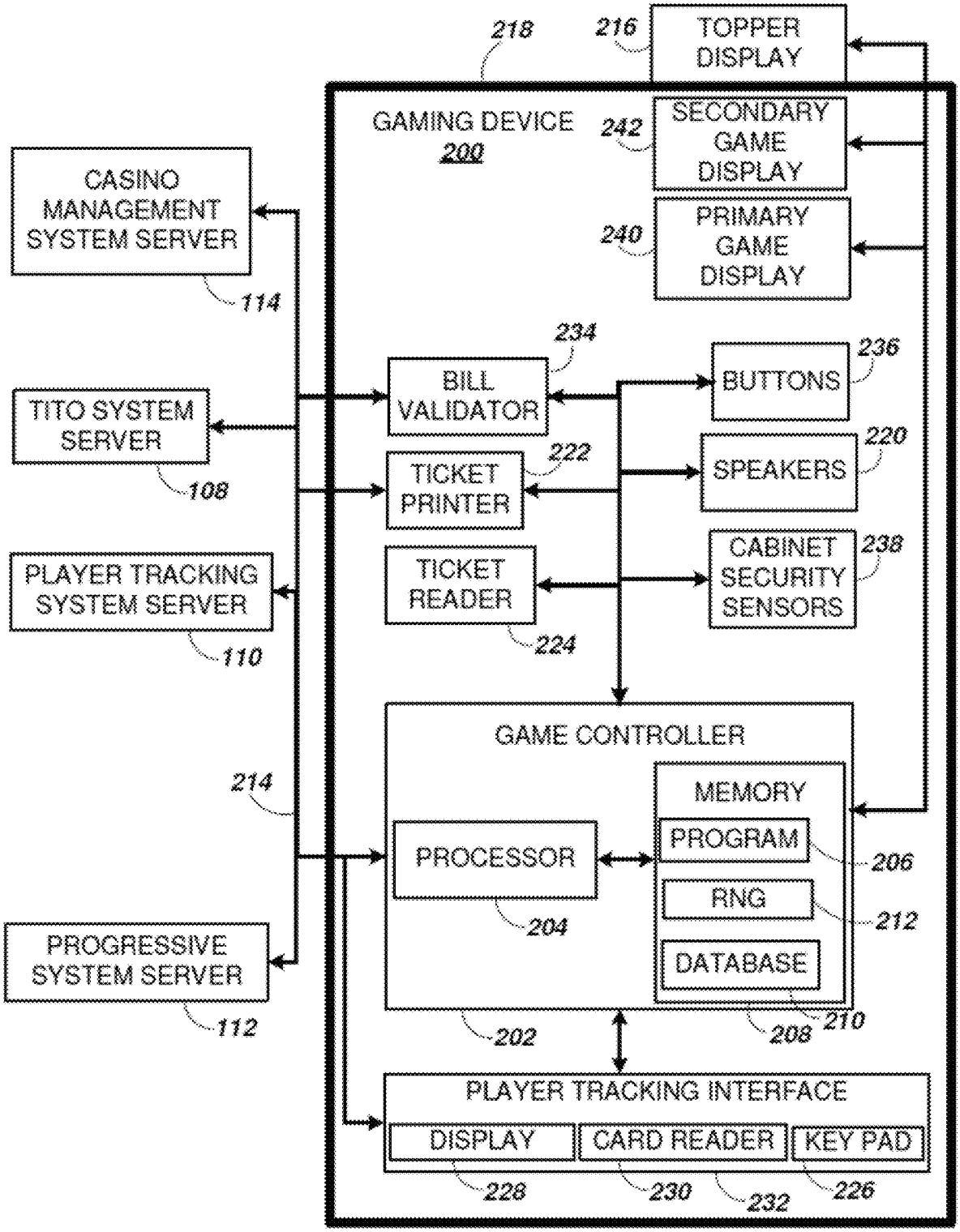
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the RNG 212 is a pseudo-random number generator.

Alternatively, a game instance (i.e., a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM, or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play, and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment, and/or additional play. Player tracking information may be combined with other information that is now readily obtainable by a casino management system.

Gaming devices, such as gaming devices 104A-104X and 200, are highly regulated to ensure fairness and, in many cases, gaming devices 104A-104X and 200 are operable to award monetary awards (e.g., typically dispensed in the form of a redeemable voucher). Therefore, to satisfy security and regulatory requirements in a gaming environment, hardware and software architectures are implemented in gaming devices 104A-104X and 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of gaming devices 200. These differences require substantial engineering effort with respect to game design implementation, hardware components, and software.

One regulatory requirement for games running on a gaming device, such as gaming device 200, generally involves complying with a certain level of randomness (e.g., that outcomes will be statistically independent, uniformly distributed over their range, unpredictable and pass statistical tests such as chi-square test, equi-distribution test, gap test, runs test, serial correlation test, etc.) Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG 212 can be integrated into the game controller 202 or processor 204. The RNG operations are often specialized and non-generic in order to comply with regulatory and gaming requirements. For example, in a reel game, program 206 can initiate multiple RNG calls to RNG 212 to generate RNG outcomes, where each RNG call and RNG outcome corresponds to an outcome for a reel. (Gaming regulations may require that each reel outcome be independent of each other reel outcome, such that no reel outcome depends on any other reel outcome.) In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").Another regulatory requirement for running games on gaming device 200 may include ensuring a certain level of RTP (i.e., "return to player," as described herein). Similar to the randomness requirement discussed above, numerous gaming jurisdictions also mandate that gaming device 200 provides a minimum level of RTP (e.g., RTP of at least 75%).

A game can use one or more weighted tables as part of a technical solution that satisfies regulatory requirements for randomness and RTP. In particular, a weighted table can integrate game features (e.g., trigger events for special modes or bonus games, newly introduced game elements such as extra reels, new symbols, or new cards, stop positions for dynamic game elements such as spinning reels, spinning wheels, or shifting reels, or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts). Configuring a weighted table can involve engineering decisions with respect to how RNG outcomes are mapped to game outcomes for a given game feature, while still satisfying regulatory requirements for RTP. Configuring a weighted table can also involve engineering decisions about whether different game features are combined in a given entry of the weighted table or split between different entries (for the respective game features), while still satisfying regulatory requirements for RTP and allowing for varying levels of game volatility.

To meet a designated RTP, a game developer can utilize one or more weighted tables (e.g., weighted tables) to translate the RNG outcome to a symbol element, stop position on a reel strip layout, and/or randomly chosen aspect of a game feature. As an example, the weighted tables can regulate a prize payout amount for each RNG outcome and how often the gaming device 200 pays out the prize payout amounts. The gaming device 200 could utilize one weighted table to map the RNG outcome to a game outcome displayed to a player and a second weighted table as a paytable for determining the prize payout amount for each game outcome. The mapping between the RNG outcome to the game outcome controls the frequency in hitting certain prize payout amounts.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or selecting various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments, a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Some embodiments described herein and subsequently shown (e.g., FIGS. 5A-21) represent improvements in the technical area of EGM software and provide new technology, for instance, in that they improve usability of EGMs by enhancing the user experience for players, and extending and improving the quality of player time on the EGMs. In particular, the staging of multiple feature rounds of target symbol collection may facilitate an extension of the gameplay experience, giving players a longer duration, and hence more satisfying, gaming experience for their investment in the game. Likewise, the new interface, which presents staging of multiple feature rounds, each of which may utilize a unique upgraded paytable, may also serve to build and improve player understanding of player investment and/or player equity in the game, in that players may experience a sense of accomplishment and/or achievement as they advance from one feature round to subsequent feature rounds, where subsequent feature rounds may not, in at least some embodiments, become available or "unlock" until previous feature rounds have been successfully completed.

In addition, as described herein, during each of the multiple feature rounds, the use of a plurality of upgraded paytables to determine feature game awards may provide a build-up to increasing levels of game awards and result in new or improved EGM functionality such as, for example, a new game presentation and accompanying player interface that enhances and prolongs the overall gaming experience as gameplay progresses towards a penultimate or final feature game (e.g., a Frenzy feature game, as described herein). Further, use of smaller, upgraded paytables also results in a technical improvement to the functioning of the EGMs described herein, in that an appropriate upgraded paytable may be selectively applied (and a previous upgraded paytable replaced) across different feature rounds. These embodiments are thus not merely new game rules or new display patterns.

Figure 5A:
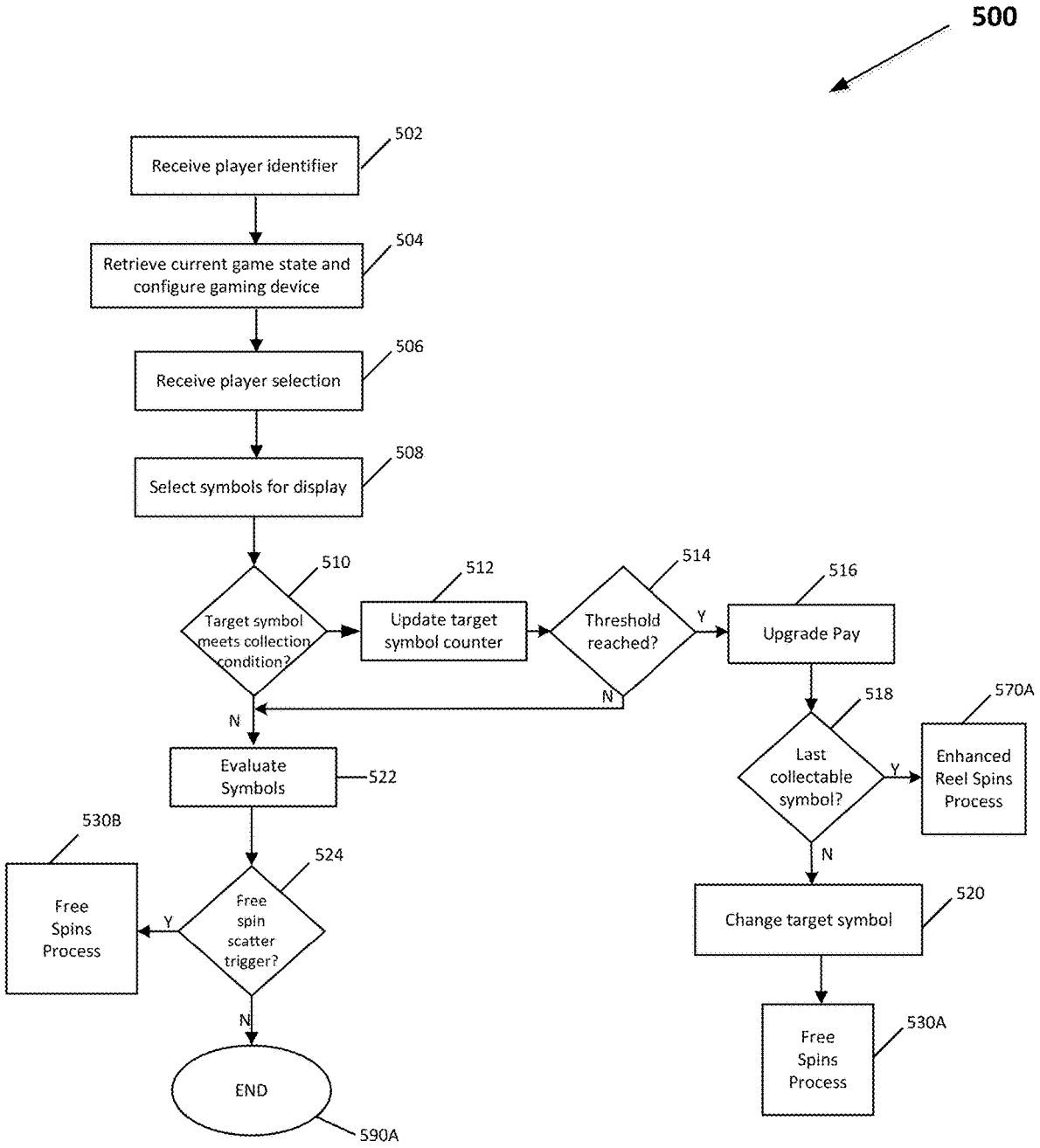
FIGS. 5A-5C are flow charts of a method of operating a gaming device.
Figure 5B:
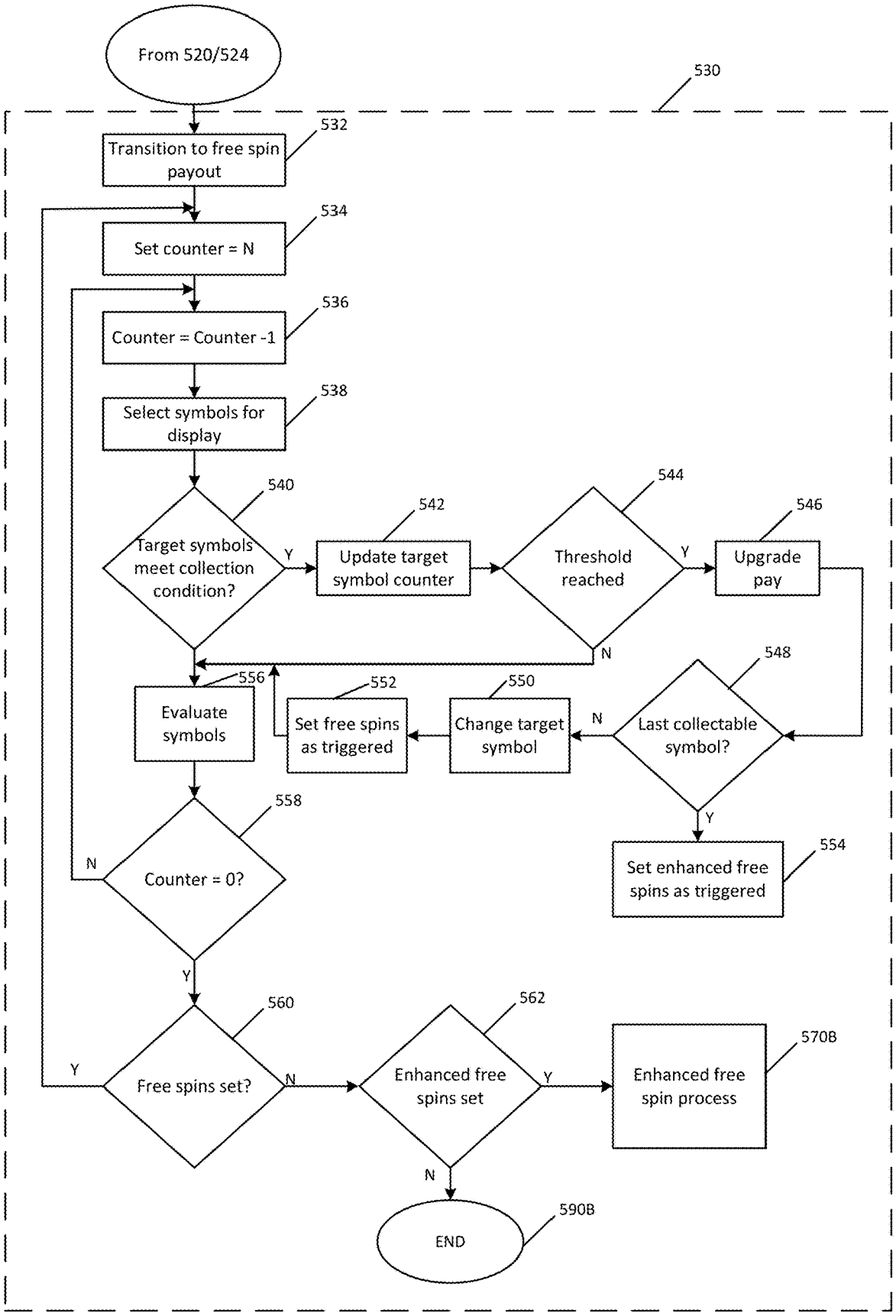
Figure 5C:
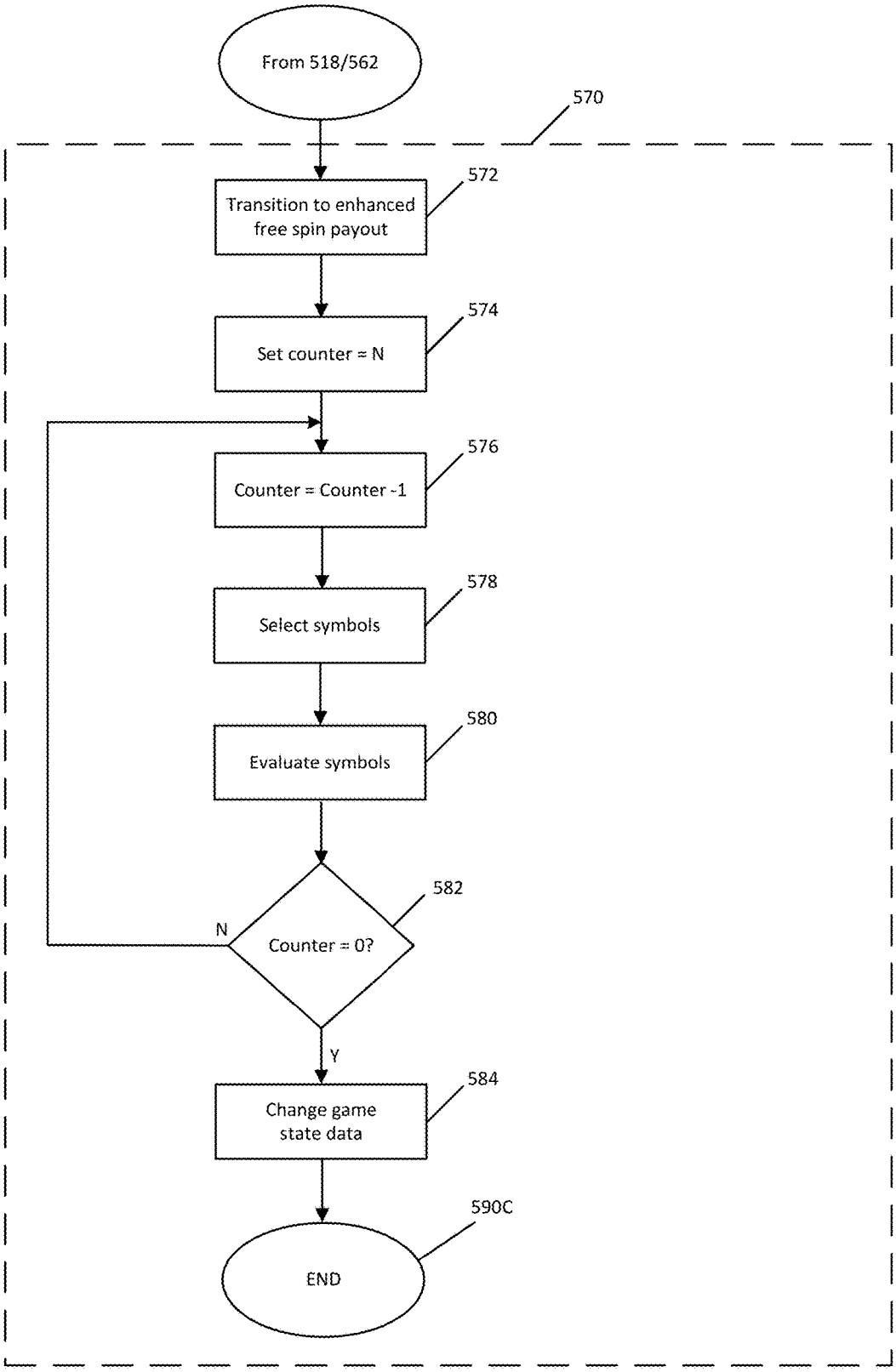

FIGS. 5A to 5C show a method 500 of operating a gaming device 200 of an embodiment. In an example, at step 502, the processor 204 receives a player identifier in the manner described above and uses it to check whether a current game state is stored in the player tracking system server 110. Where there is a current game state, at step 504 processor 204 retrieves the current game state and configures the gaming device based on the game state, for example, by setting counters in memory 208 and controlling the display 240 to display a screen corresponding to a current game state. Where there is not a stored gaming state, the processor 204 proceeds from an initial game state.

At step 506, the processor 204 receives a player input specifying a player selection for a current game, for example, responsive to a player pressing one or more buttons 236. In example embodiments, part of the player selection is to make a selection of a number of columns of symbol positions from which symbols can be collected during game play. For example, 2, 3, 4, or 5 columns of symbol positions.

Figure 4:
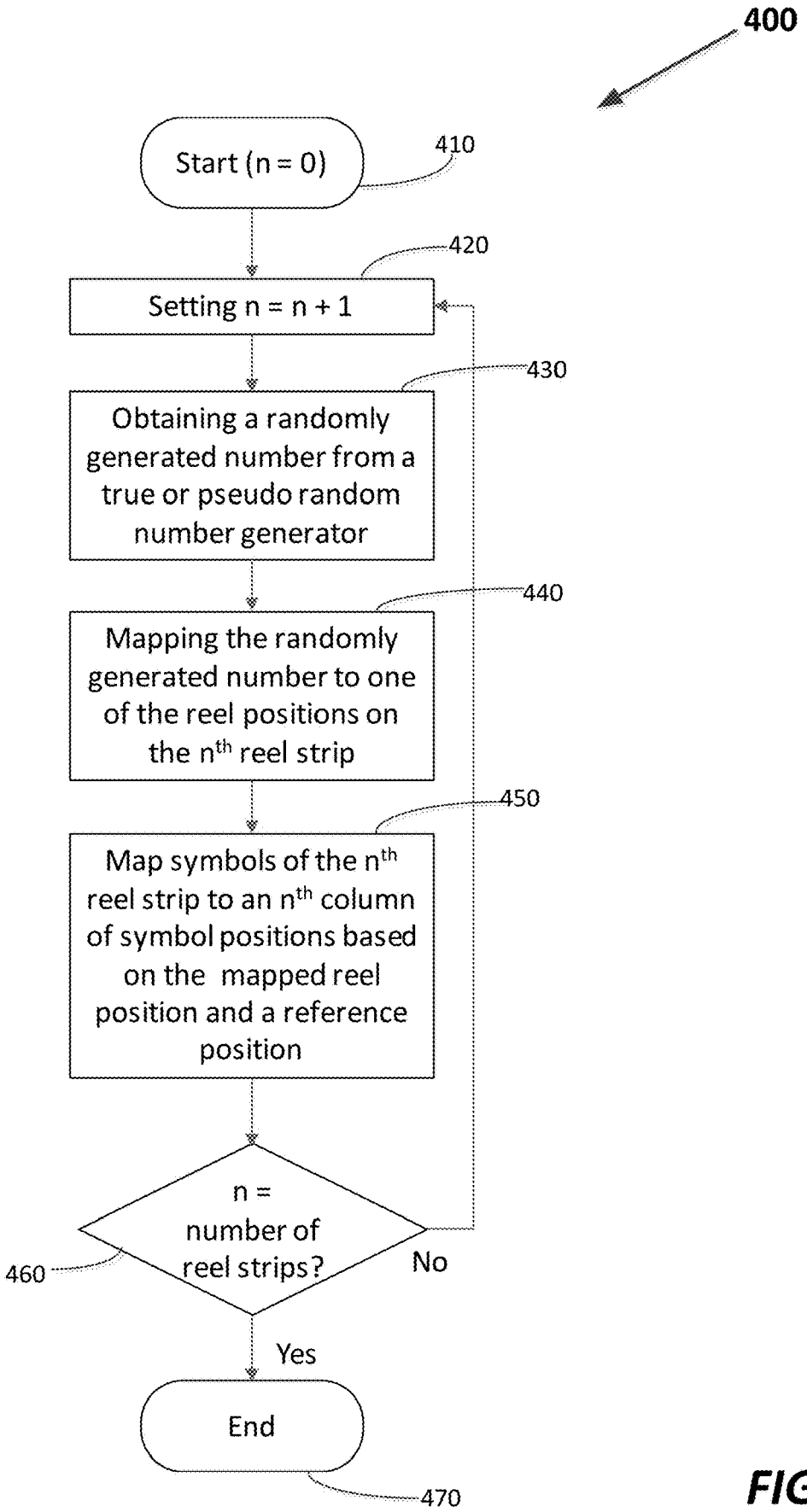
FIG. 4 is a flow chart of a symbol selection method.

At step 508, the processor selects symbols for display on the display 240 at a plurality of symbol positions. FIGS. 3 and 4 illustrate an example of symbol selection.

FIG. 3 illustrates an example of a set 300 of five-reel strips 341, 342, 343, 344, 345. In the example, each reel strip has thirty-reel strip positions 301-330. Each reel strip position of each reel has a symbol. For example, a "Wild" symbol 331 occupies the twenty-eighth reel strip position 328 of the fourth reel 344. Other reels strips to those illustrated in FIG. 3 can be used, for example, reel strips where two or more wild symbols are placed at consecutive reel strip positions of a reel strip. In other examples, the reel strips could have between 30 and 100-reel strip positions. The actual length of the game reel strips would depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP).

FIG. 4 is a flow chart of a method 400 carried out by the processor 204 to select symbols from reel strips. At step 410, the processor 204 starts the process of selecting symbols with a counter (n) set at zero as symbols have not yet been selected from any reel strips. At step 420, the processor 204 increments the counter. In the first iteration, the counter is set to 1 to reflect that symbols are to be selected from a first reel strip. At step 430 the processor obtains a randomly generated number from a true or pseudo random number generator, such as RNG 212. At step 440 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up Table. In one example, the ranges are each the same size so that each of the reel strip positions has the same chance of been selected. In other examples, the ranges may be arranged to weight the relative chances of selecting specific reel strip positions. The reel strips may be of different lengths.

At step 450, the processor 204 maps symbols of the $n^{th}$ reel strip to and $n^{th}$ column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighboring reel strip positions are also mapped to the symbol positions of the column. Referring to the example reel strips of FIG. 3, if the value returned by the RNG 212 is mapped to reel position 313, then for the first reel strip 341, "Pic 1" symbol 353 is mapped to a bottom symbol position, "10" symbol 352 is mapped to a middle symbol position, and "Pic 2" symbol 351 is mapped to a top symbol position.

At step 460, the processor 204 determines whether symbols have been selected for all of the reel strips, and if not the processor 204 reverts to step 420 and iterates through steps 430, 440, and 450 until it is determined at step 460 that symbols have been selected from all n reel strips and mapped to all n columns of symbol positions after which the symbol selection process ends 470. Different numbers of symbols may be mapped to different numbers of symbol positions.

After the symbols of all reel strips have been mapped to symbol positions, the processor 204 controls display 240 to display them at the symbol positions, which may together, define a matrix of symbol positions (e.g., a rectangular matrix of symbol positions).

In the examples described below, in certain game states, the processor 204 maps additional symbols from the reel strips to symbol positions because game outcomes in these game states include at least one more symbol position for each column of symbol positions. In the described examples, there are one or two more symbol positions. To achieve this, at step 450 the processor 204 maps one or two additional symbols from the reel strips 341-345 to symbol positions added above the existing symbol positions. Referring to the example described above where the value returned by the RNG 212 is mapped to reel position 313, adding one symbol position results in "9" symbol 354 being mapped to the added symbol position.

Figure 6:
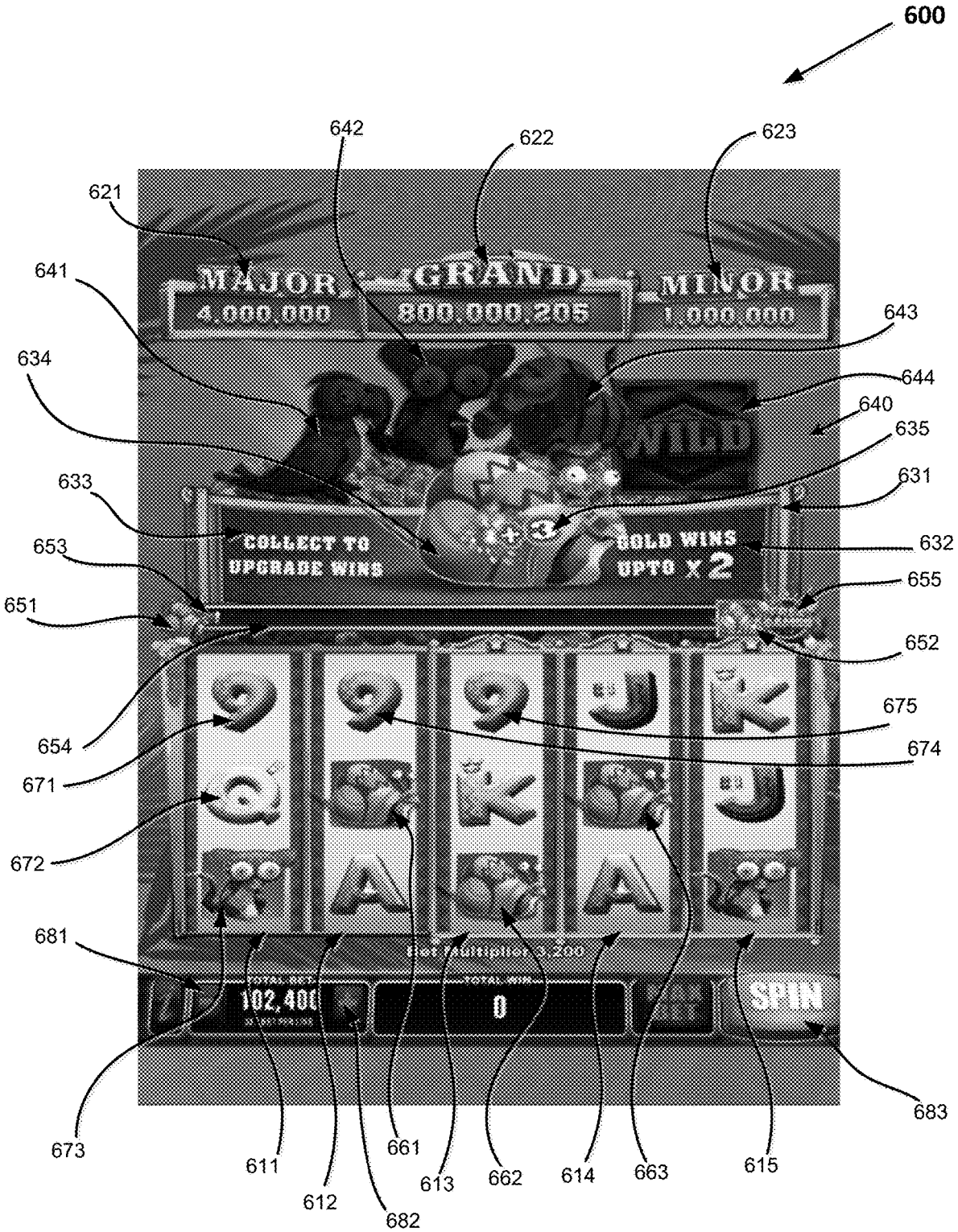
FIGS. 6 to 21 are example screen displays.

FIG. 6 shows an example screen display 600 of an embodiment. Referring to FIG. 6 there is shown five columns of symbol positions 611 to 615 corresponding to first to fifth reels which have been populated with symbols using the method of FIGS. 3 & 4. As described herein, each of the five columns of symbol positions 611-615 together define a matrix of symbol positions. In the embodiment illustrated at FIG. 6, the matrix is a 3×5 matrix of symbol positions; however, it will be appreciated that different matrices of different dimensions may be defined and applied to the wagering game, as described herein. In this example, the player has wagered a bet amount that allows collectable symbols to be collected from all of the reels.

The screen display 600 displays a collectable symbol message banner 631 which shows that the Snail symbol 634 is the current collectable symbol. In this example, Snail symbol 634 is the first collectable symbol. Message 633 indicates to the player that they need to "collect to upgrade wins" and message 632 indicates what will happen when the symbol is upgraded by stating "gold wins up to ×2", i.e., a gold version of the Snail symbol 634 will result in wins that are multiplied by up to twice the number of wins for the current symbol.

Figure 21:
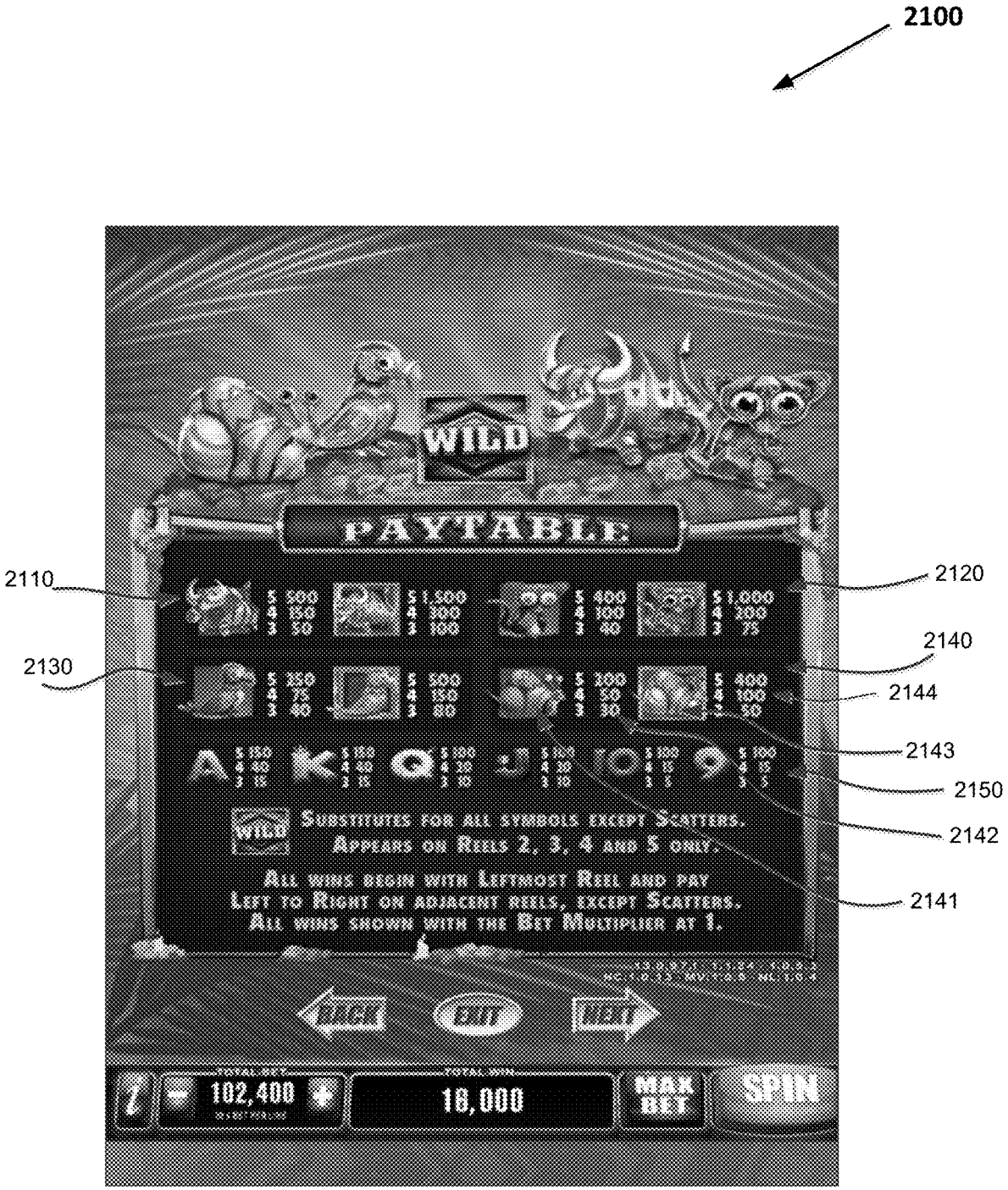

In this respect, paytable 2100 shown in FIG. 21 includes a subentry 2140 for the Snail symbols showing normal Snail symbol 2141 and pay amounts 2142 for winning combinations of five, four, and three of a kind. Snail paytable entry 2140 also shows gold Snail symbol 2143 and paytable amounts 2144 for winning combinations of five, four, and three of a kind. It will be apparent that consistent with message 632 the pay amounts ("pays") for five and four of a kind gold Snail symbols 2143 are two times the pays for five and four of a kind normal Snail symbols 2141. In this example, the pay for three of a kind of gold Snail symbols is 50 credits while the pay for three of a kind normal Snail symbol is 30 credits. Collectable symbol area 640 shows four further collectable symbols, namely Parrot symbol 641, Lemur symbol 642, Ox symbol 643, and Wild symbol 644, in a background area 640 behind Snail symbol 634. Individually collectable symbols 641, 642, 643, and 644 correspond to PIC1, PIC2, PIC3, and PIC4 in the example reel strips of FIG. 3. It will be appreciated that reel strips with different numbers of PIC symbols can be used, depending on the number of individually collectable symbols. In this game state Parrot symbol 641, Lemur symbol 642, Ox symbol 643, and Wild symbol 644 are greyed out to indicate they have not been collected. Above the collectable symbols 634, 641-644 are values of Major 621, Grand 622, and Minor 623 Jackpot prizes. Similar to snail paytable entry 2140, in at least some embodiments, paytable 2100 may include subentries for other symbols, such as an ox subentry 2110, a gold lemur subentry 2120, a parrot subentry 2130, and the like.

At step 510, the processor 204 determines whether there are target symbols that meet the collection condition. In the current game state, the target symbol is the Snail symbol as this is the first collectable symbol and the collection condition is that the Snail symbol appears in any of the symbol positions because the player selection has made a selection to activate all columns of symbol positions.

In the example of FIG. 6, Snail symbols 661, 662, and 663 have been selected by the process of FIGS. 3 and 4. Accordingly, at step 512 processor 204 updates a target symbol counter in memory 208 to reflect that there are three additional collected Snail symbols. That is, target symbol counter is used to hold the number of the current collectable symbol that have been collected. Processor 204 also controls display 240 to display the message "+3" 635 to indicate that three symbols are to be added to the target symbol counter. Processor 204 also updates the progress graphics 634 for the Snail collectable symbol by moving an indicator in the form of progress bar 653 an amount corresponding to the collection of three symbols. In order to communicate the current state of symbol collection to the player, progress collection graphic 654 shows on a left side the Snail symbol 651 and on a right side a gold Snail symbol 652 indicates that the Snail symbol will be upgraded to the gold Snail symbol in subsequent game instances once the player collects sufficient Snail symbols. Message 655 indicates that free games will also be awarded once the player collects sufficient Snail symbols. As a result, the player can readily see how far the game state has progressed from the initial game state as well as what awards and ongoing benefits will apply after sufficient Snail symbols have been collected.

At step 514, the processor determines whether a threshold has been reached in respect the collection of the first collectable symbol. The processor 204 achieves this by comparing the current value of the number of first collectable symbols stored in counter in memory 208 to a defined threshold number for the first symbol stored in memory. In an example, as shown in Table 1 below, the threshold number may be 500 Snail symbols. In this respect, referring to Table 1, the term "Pic 4" corresponds to the Snail symbol shown in FIG. 6, "Pic 3" corresponds to the Parrot symbol 641, "Pic 2" corresponds to the Lemur symbol 642, and "Pic 1" corresponds to the Ox symbol 643.

In the example shown in FIG. 6, the threshold has not been reached and accordingly the processor 204 proceeds to step 522 and evaluates symbols based on the paytable 2100. In this example, the processor will evaluate for winning combination the un-upgraded paytable values for each of the collectable symbols.

As indicated in FIG. 21, in this example, the evaluations are reel based evaluations where a winning combination occurs each time a number of symbols defined in paytable 2100 occurs on consecutive reels starting with a left most reel. In an example, in order to perform the evaluation at step 522, the processor 204 begins by determining which symbols have been selected in the left most column of symbol positions 611 as these are the only symbols that can form winning combinations. Accordingly, in the example of FIG. 6, winning combinations can only occur for the "9" symbol 671, "Queen" symbol 672, and the "Lemur" symbol 673. Accordingly, the processor 204 determines for each of these symbols whether there is another symbol of the same kind in the second left most column 612 of symbol positions. In this case there are no instances of the Queen symbol 672 or the Lemur symbol 673 in second column 612. Accordingly, the processor 204 ceases evaluating whether these symbols form part of a winning combination but continues evaluations in respect of the "9" symbol as there is a second "9" symbol 674 in the second column 612. Processor 204 then proceeds to third column 613 and determines that there is a third "9" symbol 675. Processor then proceeds to fourth column 614 and determines that there are no more "9" symbols and ends the evaluation of winning combinations. Processor 204 then compares the value of three "9" symbols to paytable 2100 and determines that there is a winning combination 2150 for three of a kind "9" symbols which awards a value of 5 credits for a base wager. Processor 204 then adds the amount multiplied by any bet multiplier to a win meter in memory 208.

While not shown in FIG. 6, at step 522 processor can take into account WILD symbols which substitute for all other symbols except scatter symbols in win combinations.

At step 524, processor 204 evaluates whether there is a free spin scatter trigger defined by a defined number of scatter symbols being selected at the symbol positions of columns 611-615. In this example 3, 4, or 5 scatter symbols. As there are no scatter symbols shown in FIG. 6, the processor 204 proceeds to step 590A and ends the game and awaits the receipt of a further player selection at step 506. However, if scatter symbols are shown, processor 204 may, in at least some embodiments, continue to free spins process 530B.

Figure 7:
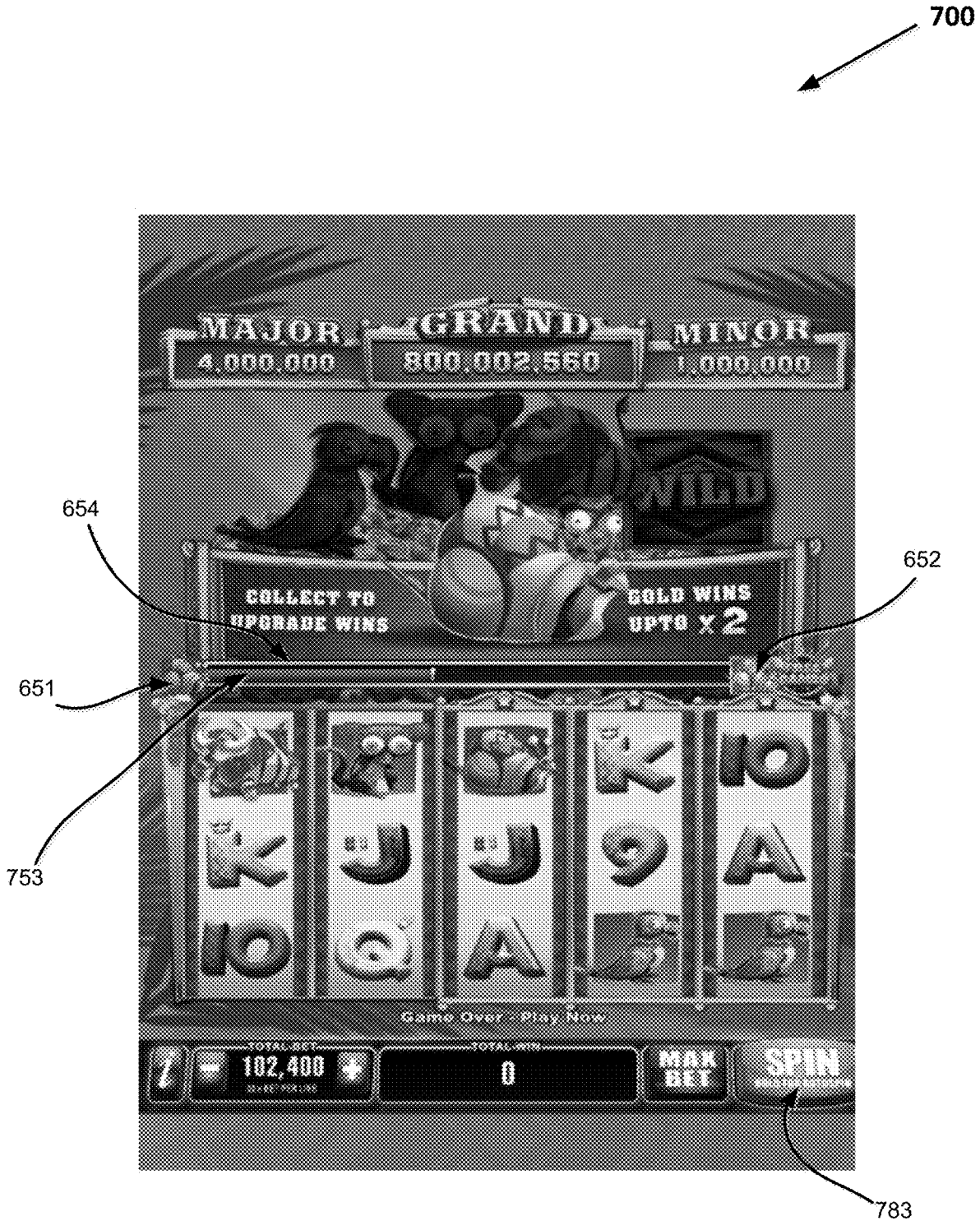

In this respect, an initial player selection may require the player to make a number of selections. For example, referring to FIG. 6 by, pressing up and/or down buttons 681, 682 in order to specify a total amount bet and then pressing spin button 683. A subsequent player selection may involve the player merely pressing spin button 683 or as shown in the example of FIG. 7 holding button 783 a defined amount of time in order to initiate auto-spin (continuous initiation of new games until interrupted).

Accordingly, it will be appreciated that, the processor 204 will usually cycle through step 514 a number of times before a threshold value is reached, particularly in the case where the threshold number of symbols is 500 symbols as shown in the example of Table 1.

Figure 8:
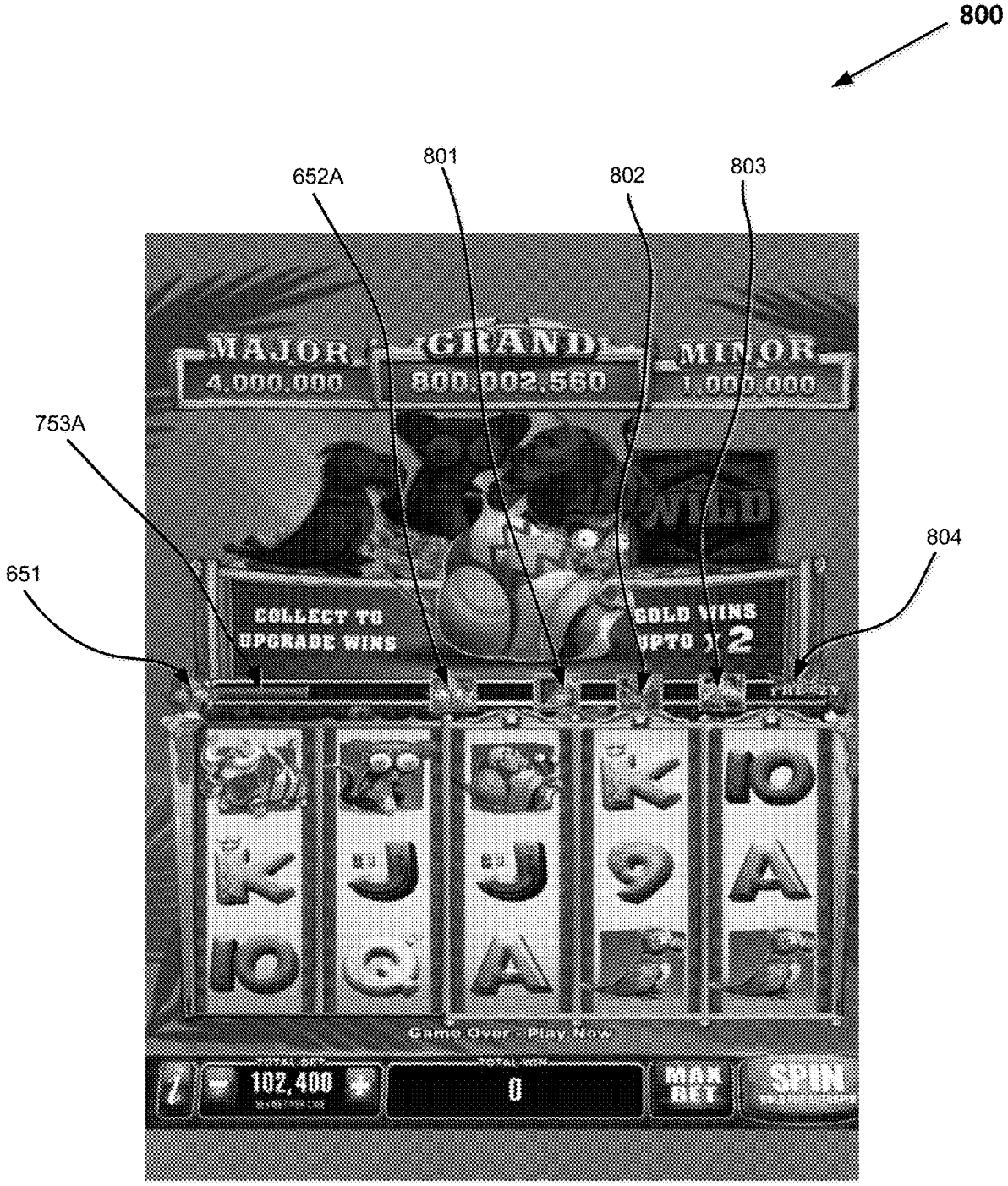
Figure 9:
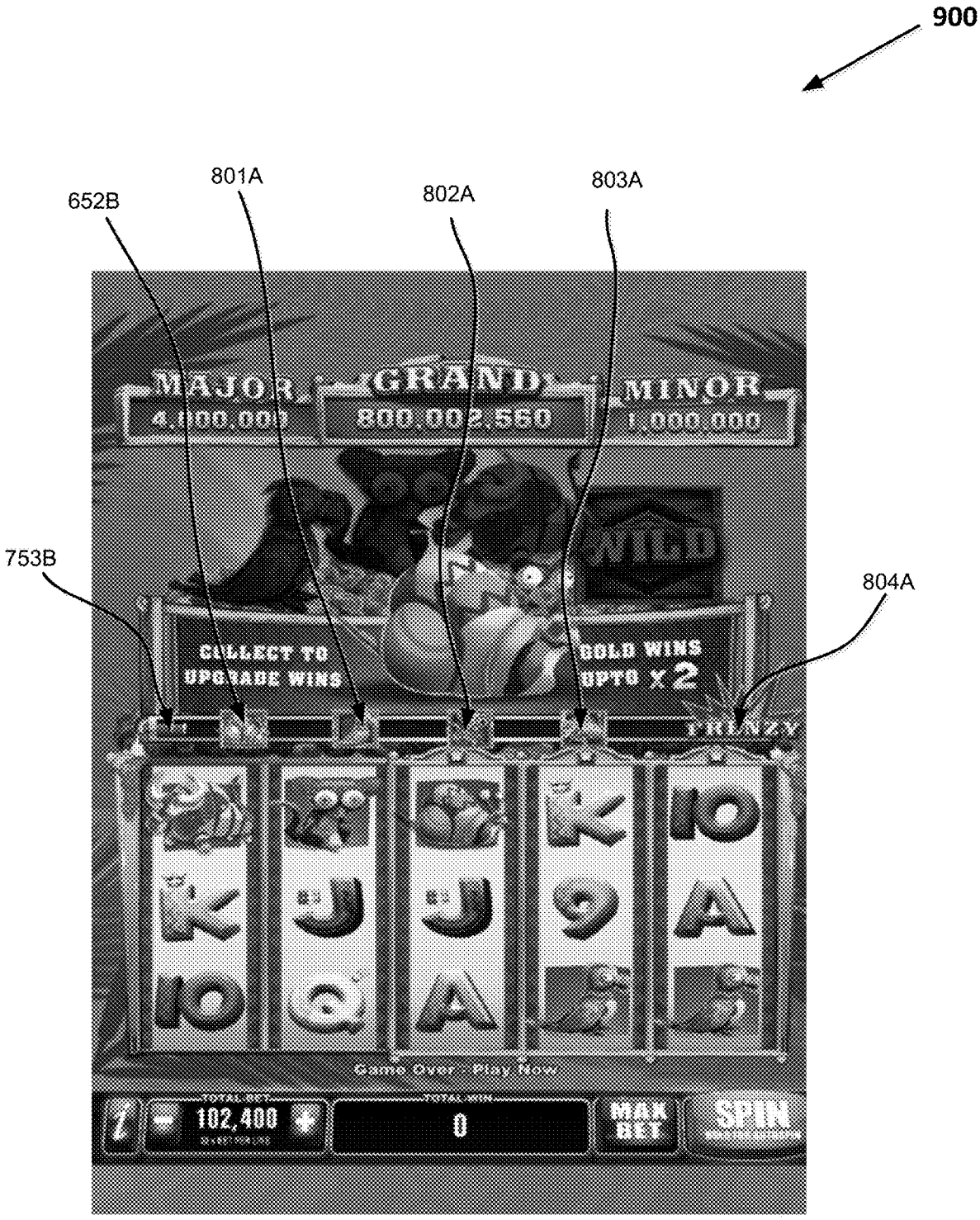

As the game state proceeds towards a game state in which the threshold is reached, the user interface is updated to indicate progress. In this respect, in the example display screen 700 shown in FIG. 7, progress bar 753 has moved to a point further to the right relative to the progress bar 653 in FIG. 6 and closer to the gold Snail symbol 652. The processor 204 controls display to display this progress graphic in an area above the area in which the symbols are displayed. As shown in FIGS. 8 and 9, the processor 204 transitions between a first progress graphic which shows the progress towards collecting the target number of Snail symbols and a second progress graphic shown in FIG. 9 which shows progress towards collection the target numbers of all the collectable symbols.

In this respect, FIG. 8 shows a screenshot 800 of an intermediate state where the transition between the two progress graphics is animated. FIG. 8 shows gold Snail symbol in a second, intermediate position 652A as well as displaying Parrot symbol 801, Lemur symbol 802, and Ox symbol 803 on the progress bar 753A. The right most symbol 804 reflects that the collection of all the collectable symbols which will trigger a free game feature known as the "Frenzy" feature. As can be observed from FIG. 8, these additional icons are animated as sliding out from the right most side of the display until they reach the position of the second progress graphic as shown in the screenshot 900 of FIG. 9, where the icons are evenly spaced between the left side of the progress bar 654 and the right most side which is the Frenzy graphic 804A. That is, Snail symbol is shown in third position 652B, Parrot symbol is shown in a second position 801A, Lemur symbol is shown in second position 802A, and Ox symbol is shown in a second position 803A while Frenzy symbol 804A has reached full size. Progress bar 753B has been scaled to show the same relative position between the left side of the progress indicator and the Snail symbol in FIG. 9.

Figure 10:
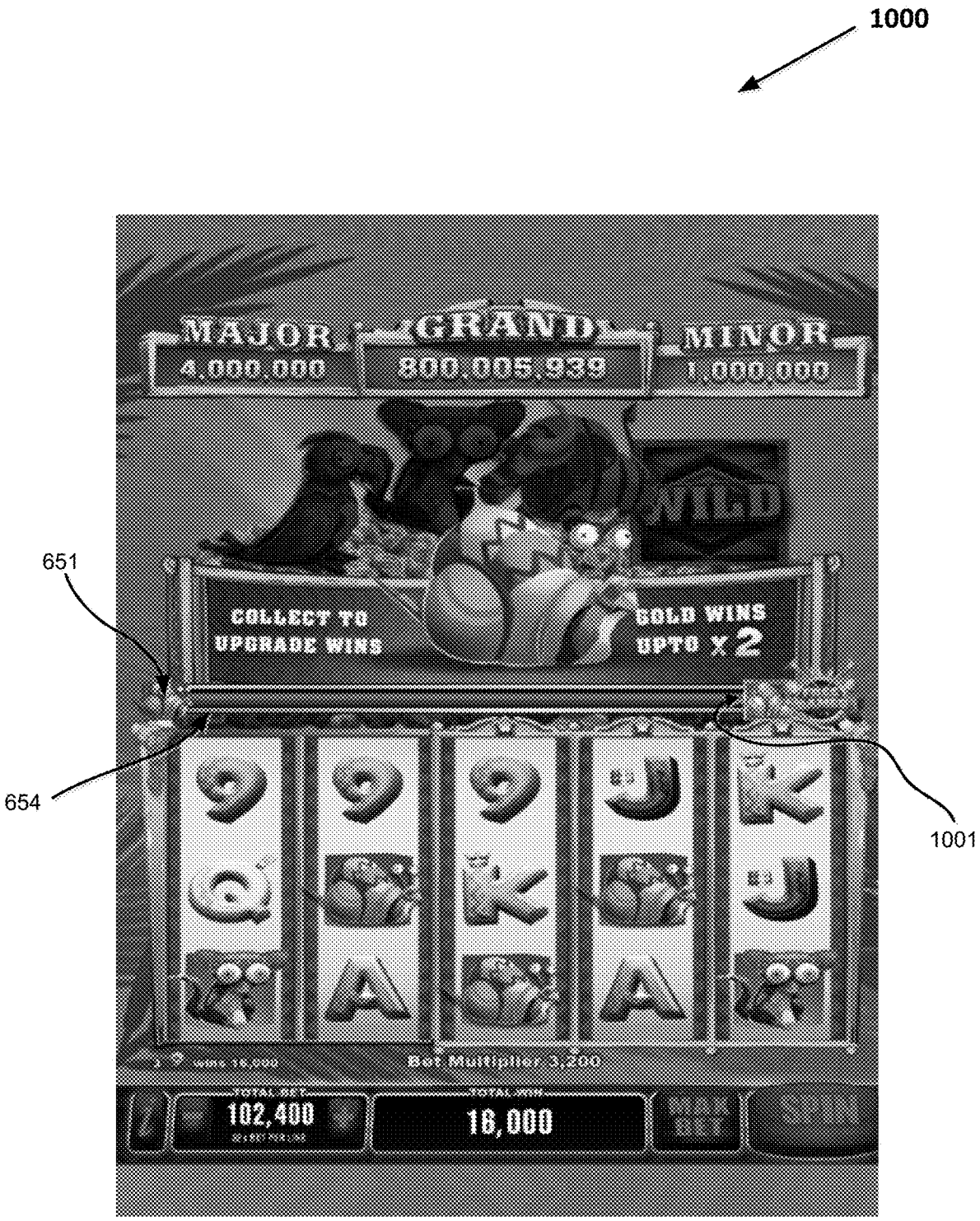
Figure 11:
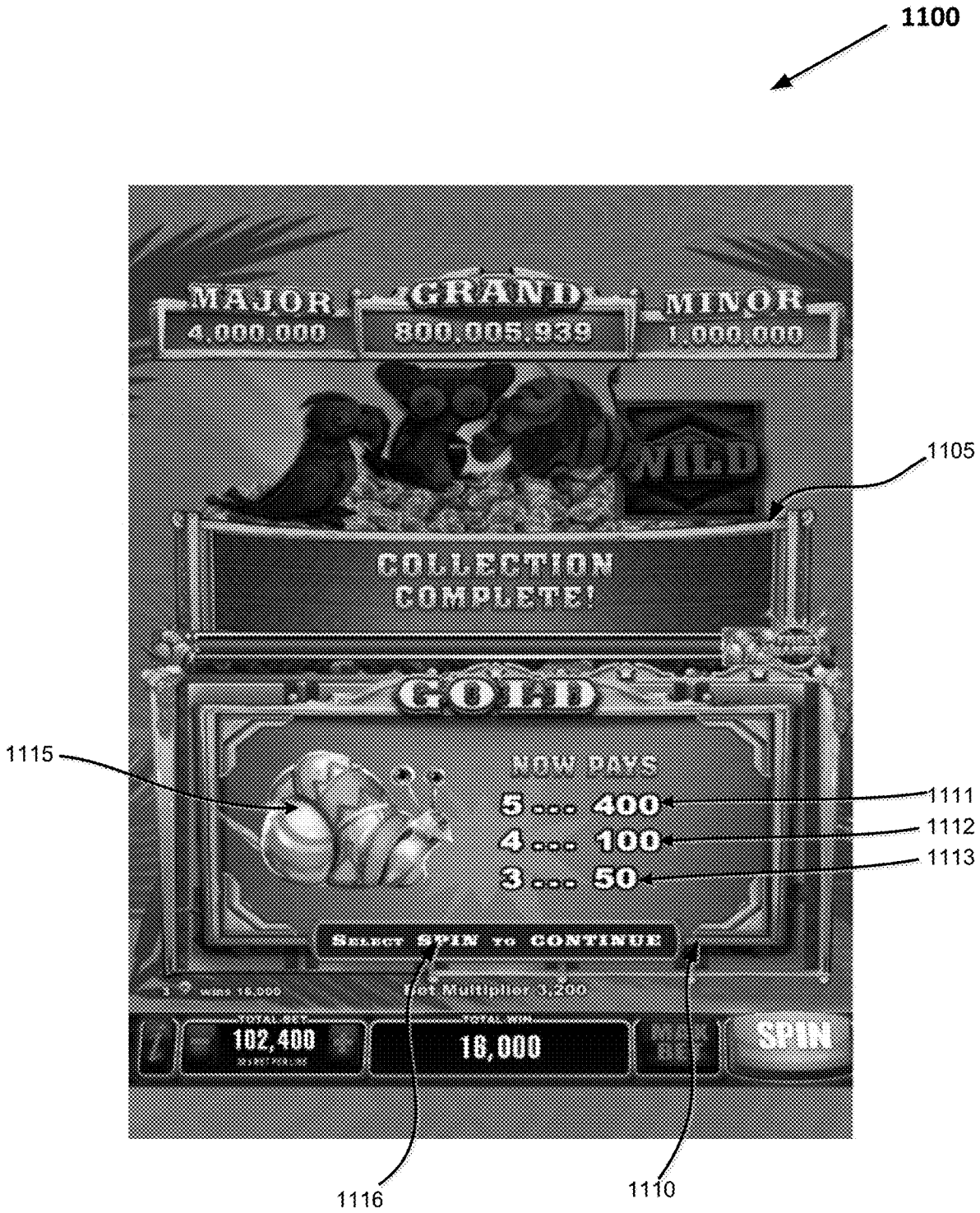
Figure 12:
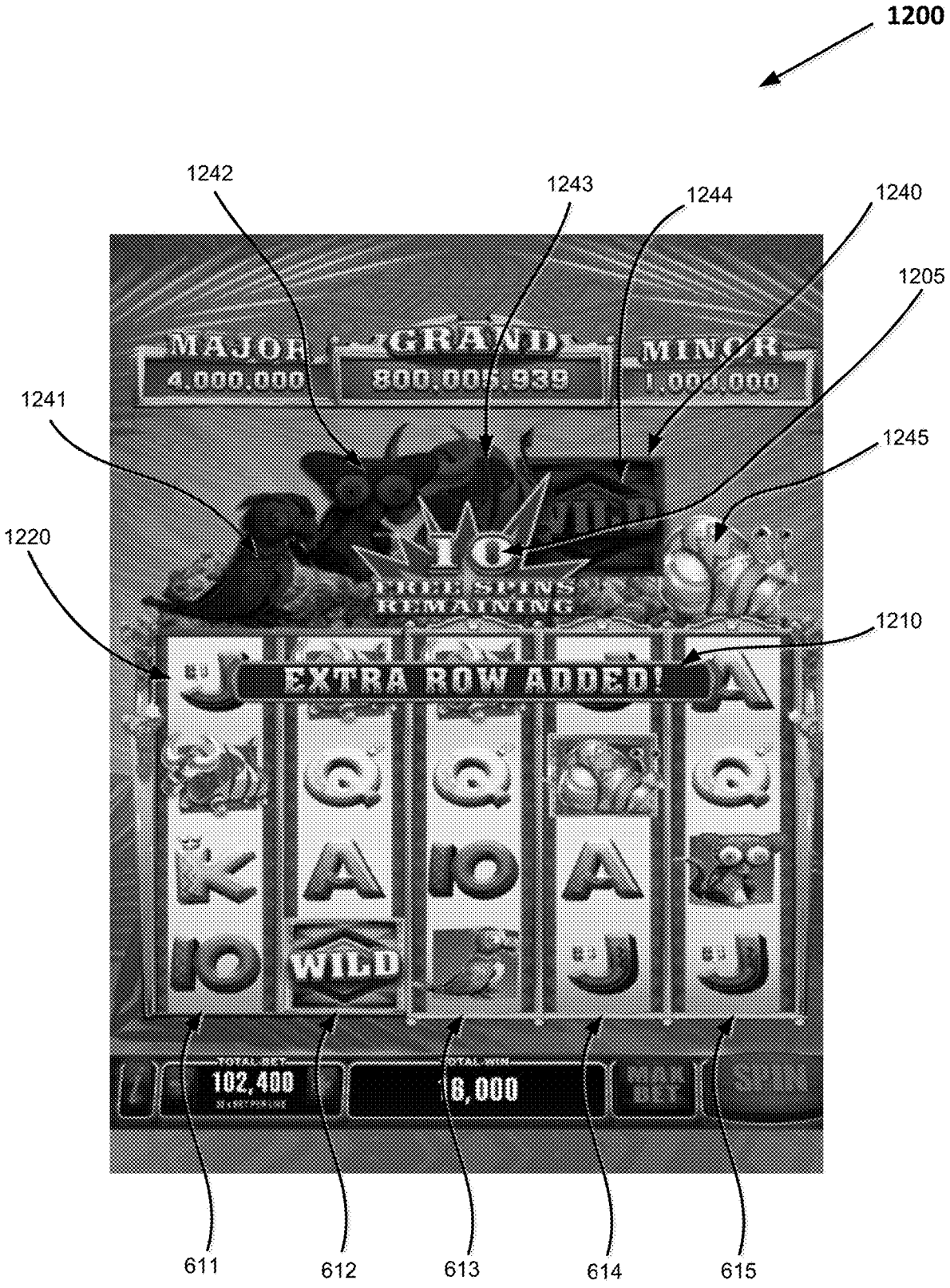

After the defined number of first collectable symbols have been collected, the processor will determine at step 514 that the defined threshold has been reached. That is, that the number of symbols that have been collected reaches a defined number. In this respect it will be appreciated that in the game instance in which the threshold is reached there may be more occurrences of the first collectable symbol (in this example, the Snail symbol) than are required to be added to the counter to reach the defined number and hence the threshold may be exceeded in this final game instance. Alternatively, the gaming device may be configured such that once the defined number is reached, it stops counting. FIG. 10 is an example screen display 1000 where the progress bar 654 has reached the threshold 1001.

When this game state is reached, the processor 204 proceeds to step 516 of upgrading the amount payable for winning combinations in respect of the first collectable symbol. As part of this process, the processor 204 controls the display to display a paytable upgrade screen 1100 with the message "Collection Complete" 1105 and a paytable upgrade message 1110 which explains that the Snail symbol is now gold Snail 1115 which now pays 400 credits for five of a kind 1111, 100 credits for four of a kind 1112, and 50 credits for three of a kind 1113. A message "select spin to continue" 1116 is displayed to explain to the player what to do next.

It will be apparent that in this example, the processor 204 both changes the representation of the symbol and the paytable that applies. In other examples, the processor 204 may only change the paytable. In this example, the processor 204 replaces each occurrence of the Snail symbol (in this example, Pic 4) on each of the reel strips 311-315 shown in FIG. 3 with the gold Snail symbol 1115.

In other examples, processor 204 could change to a different set of reel strips having the gold Snail symbol 1115 at the same positions as the normal Snail symbol.

Figure 13:
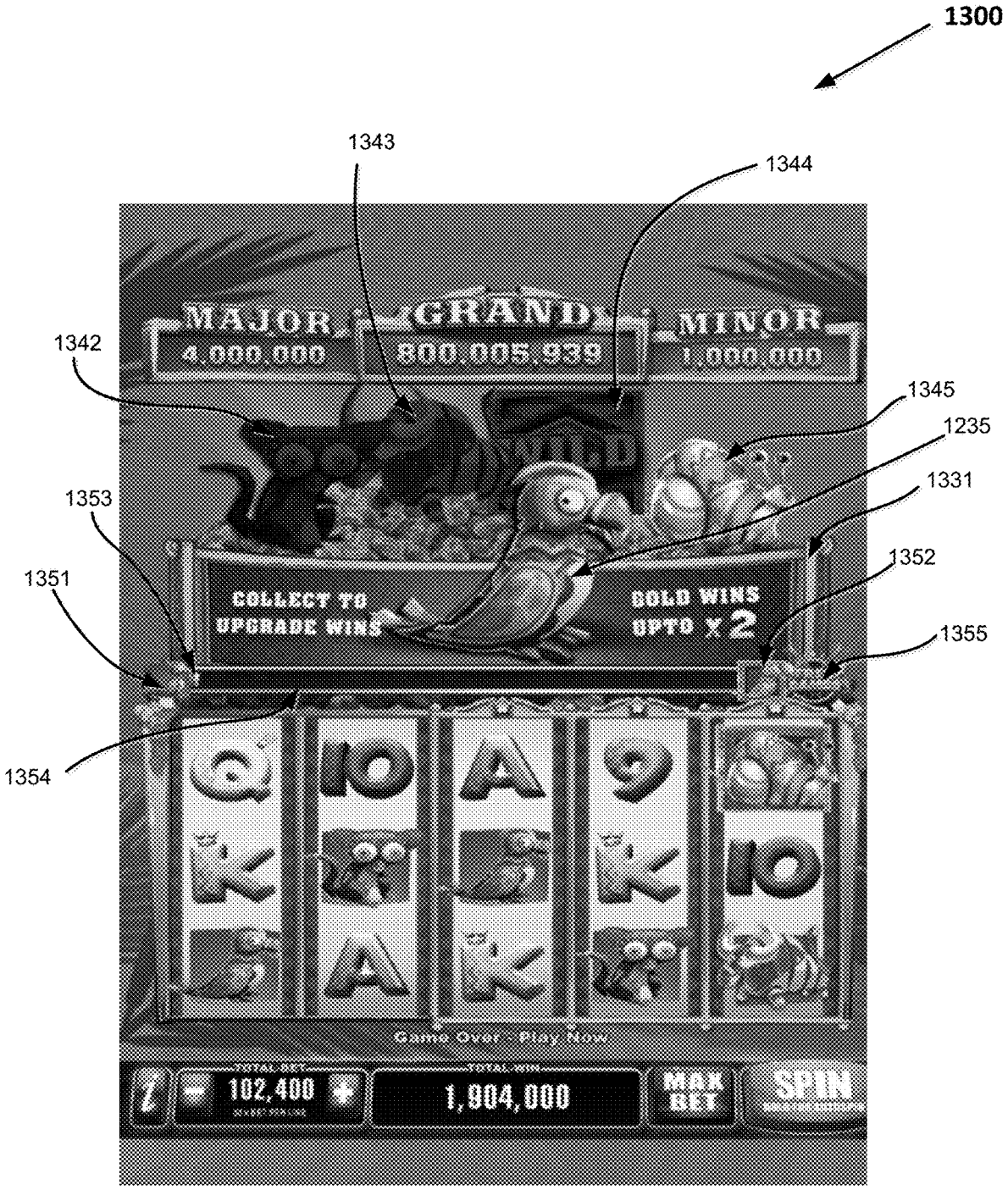

At step 518, the processor 204 determines whether this is the last collectable symbol and if not at step 520 changes the target symbol to a second collectable symbol such that in this example, the target symbol will now be the Parrot symbol as will be explained in further detail below in relation to FIG. 13. Processor then proceeds to step 530A of conducting a free spin process. In the example, the Snail symbol is the first collectable symbol, accordingly, processor 204 proceeds to step 530A.

The free spin process 530 of an example is shown in FIG. 5B. In this respect, as shown in FIG. 5A there are two ways of entering the free spin process. One via upgrade of a paytable and secondly, via a scatter trigger at step 524. Accordingly, processor 204 enters free spin process 530 in one of two ways and then transitions to a free spin layout at step 532. An example screen display of a free spin layout is shown in the screenshot 1200 of FIG. 12 from which it will be apparent that an additional row 1220 of symbol positions has added. That is, an extra symbol position has been added to each column of symbol positions 611-615. A message 1210 "extra row added" indicates to the player that row 1220 has been added. Message 1205 indicates to a player that there are "10 free spins remaining", i.e. that the player will receive 10 free spins of the reel without needing to place an additional wager.

The background 1240 above the array of symbol positions has been updated to show the gold Snail symbol 1245 while the remaining symbols 1241-1244 are moved but are still showing as greyed out.

At step 534, the processor 204 sets a counter to the initial number of free spins (N). In this case, N=10. At step 536, the processor 204 decreases the counter by 1. At step 538, the processor 204 selects symbols for display from the reel strips that have been adjusted to incorporate the upgraded first collectable symbol. The symbols are selected in accordance with the process described in relation to FIGS. 3 and 4. At step 540, the processor 204 determines whether any target symbols meet the collection condition.

That is, in this example, the player can collect the target symbol during the free games. In other embodiments, the free games may be carried out without target symbol collection. That is, the target symbol may not be updated until after the free spins are completed. However, in the example shown in FIG. 5B, the process proceeds by determining at step 540 whether target symbols meet collection conditions using the same technique as described in relation to step 510 above. Further, at step 542, the processor 204 updates the target symbol counter in memory 208 and determines at step 544 whether the threshold value for this collectable has been reached.

It will be appreciated that when a target symbol has just been collected, processor 204 is unlikely to determine at step 544 that a threshold has been reached in respect of the new collectable symbol. However, this is more likely to occur when the processor 204 enters the free spin process 530 after a scatter trigger is determined to have occurred at step 524. Assuming the threshold has not been reached, the processor 204 proceeds to step 556 and evaluates the symbols where the process proceeds from the example shown in FIG. 11, the currently applicable paytable will include the upgraded pay value for the Snail symbol. At step 558, the processor 204 determines whether the counter has reached "0" and if not, reverts to step 536 and decreases the counter to "0" again.

Where at step 544, the processor 204 determines that a threshold has been reached, the processor 204 proceeds to step 546 of upgrading a paytable before determining at step 548 whether the last collectable symbol has been collected. If so, processor 204 proceeds to step 554 of setting enhanced free spins as triggered. If not, the processor 204 proceeds to step 550 and changes the target symbol and sets the free spins as triggered 552. By setting the free spins triggered at steps 552, the processor 204 can determine at later step 560 whether or not free spins are being set. If the free spins have been set, the processor 204 reverts to step 534 and reinitializes a counter to the set number of free spins. Note that depending upon the example, different numbers of free spins may be set depending on the circumstances that led to the free spins being triggered. For example, different numbers of free spins are linked to the number of scatter symbols in a free spin scatter trigger or different numbers of free spins based on which symbol was collected as exemplified in Table 1 as set out below which will be described in further detail below.

FIGS. 13-18 are additional screen displays 1300-1800 that illustrate how the user interface is updated to reflect the symbol collection process. The screen display 1300 of FIG.

13 shows an example where banner 1231 shows that the target collectable symbol has been changed to the Parrot symbol 1235. In the first progress graphic, an updated collection gauge 1354 is displayed with a Parrot symbol 1351 on the left end. A gold Parrot symbol 1352 and a free games message 1355 are displayed at the right-hand end of the gauge.

Progress bar 1353 is at the left-hand end of the gauge 1354 to indicate the limited progress (at this stage) towards collecting the defined number of Parrot symbols which in the example of Table 1 is 500. Behind banner 1331, are displayed the gold Snail symbol 1345 to indicate that it has been collected and greyed out Lemur symbol 1342, Ox symbol 1343, and WILD symbol 1344 whose positions have been moved relative to FIG. 6 to indicate that the Lemur symbol will be the next symbol for collection.

Figure 14:
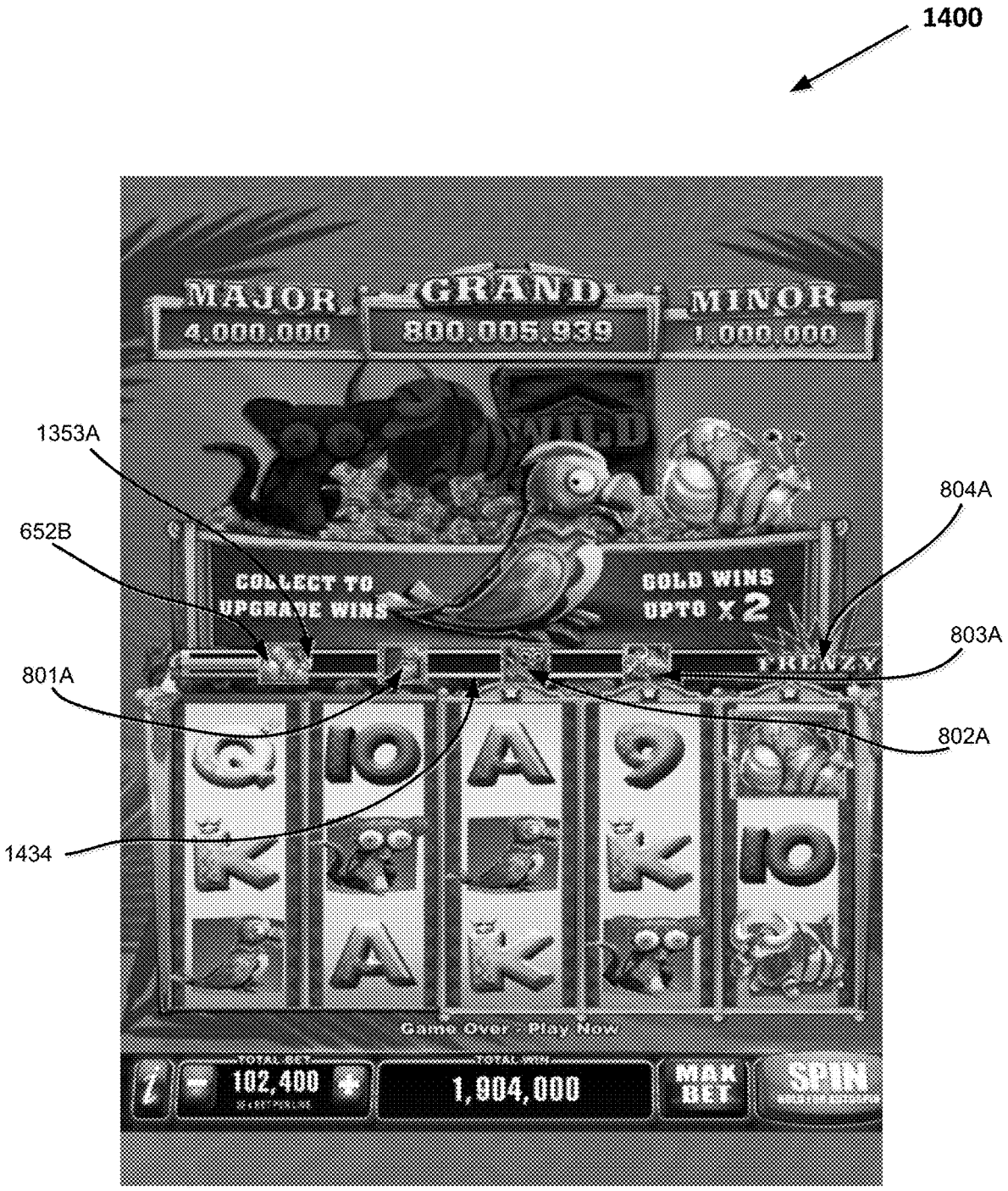

FIG. 14 shows an example screen display 1400 where the second progress graphic is displayed to show progress towards collection of the target numbers of all of the collectable symbols. The second progress graphic displays the gold Snail symbol 652B, a Parrot symbol 801A, Lemur symbol 802A, Ox symbol 803A, and Frenzy symbol 804A at spaced apart locations on collection gauge 1434 with progress bar 1353A scaled to show progress between collection of the gold Snail symbol and the Parrot symbol.

Figure 15:
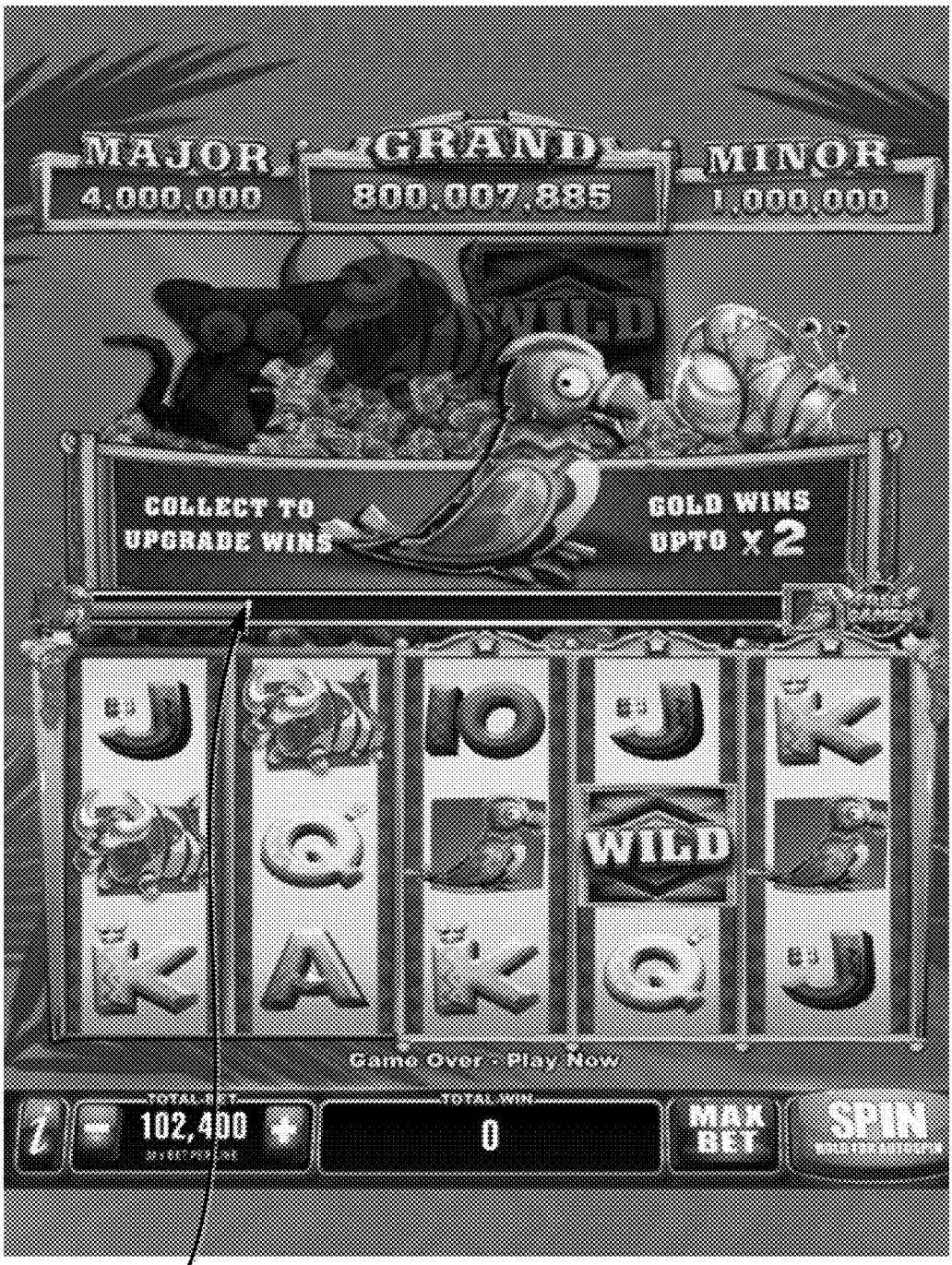
Figure 16:
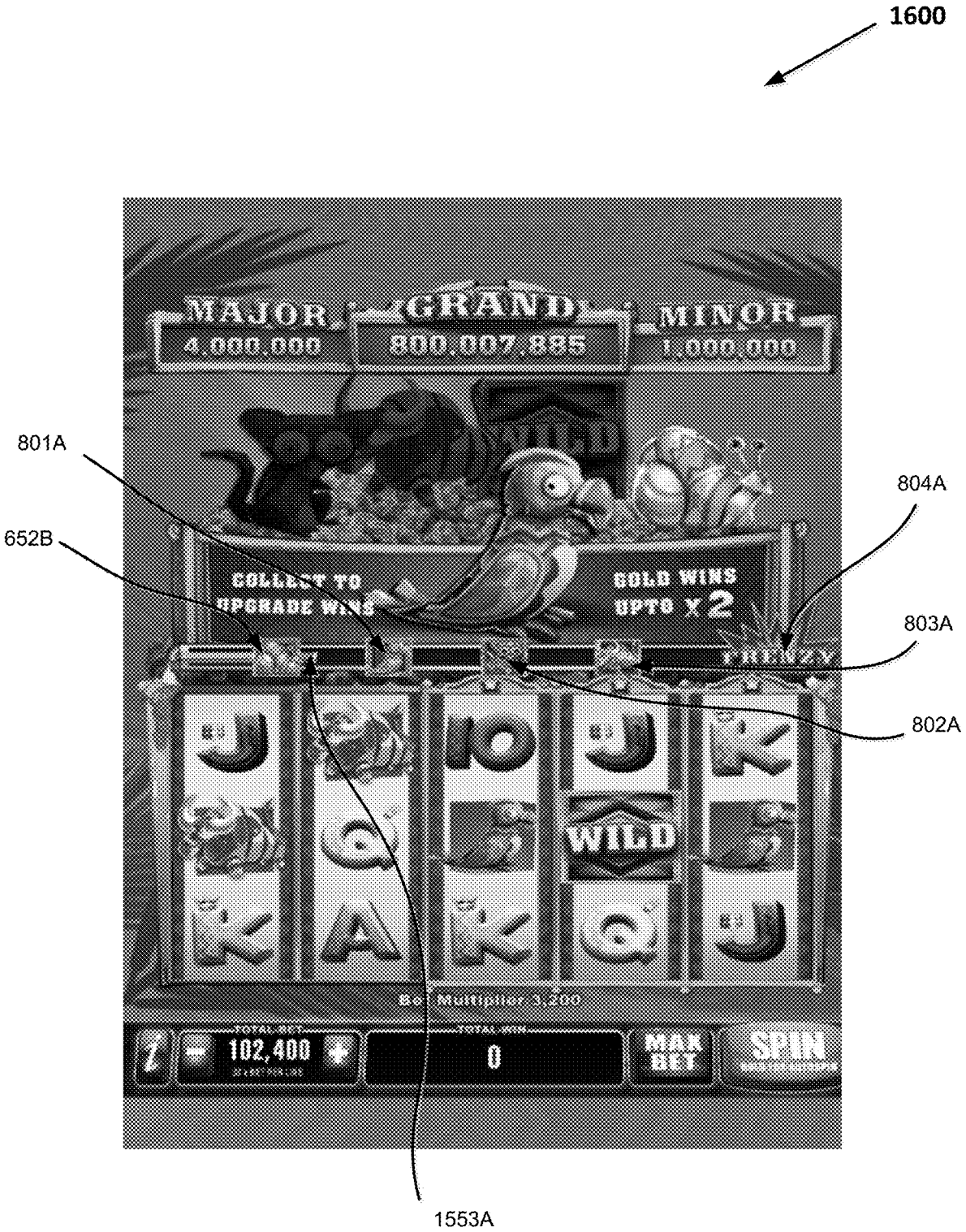

FIG. 15 shows as an example a screen display 1500 of the first progress graphic where progress bar 1553 has advanced further to the right and FIG. 16 shows the second progress graphic with a scaled progress bar 1553A.

Figure 17:
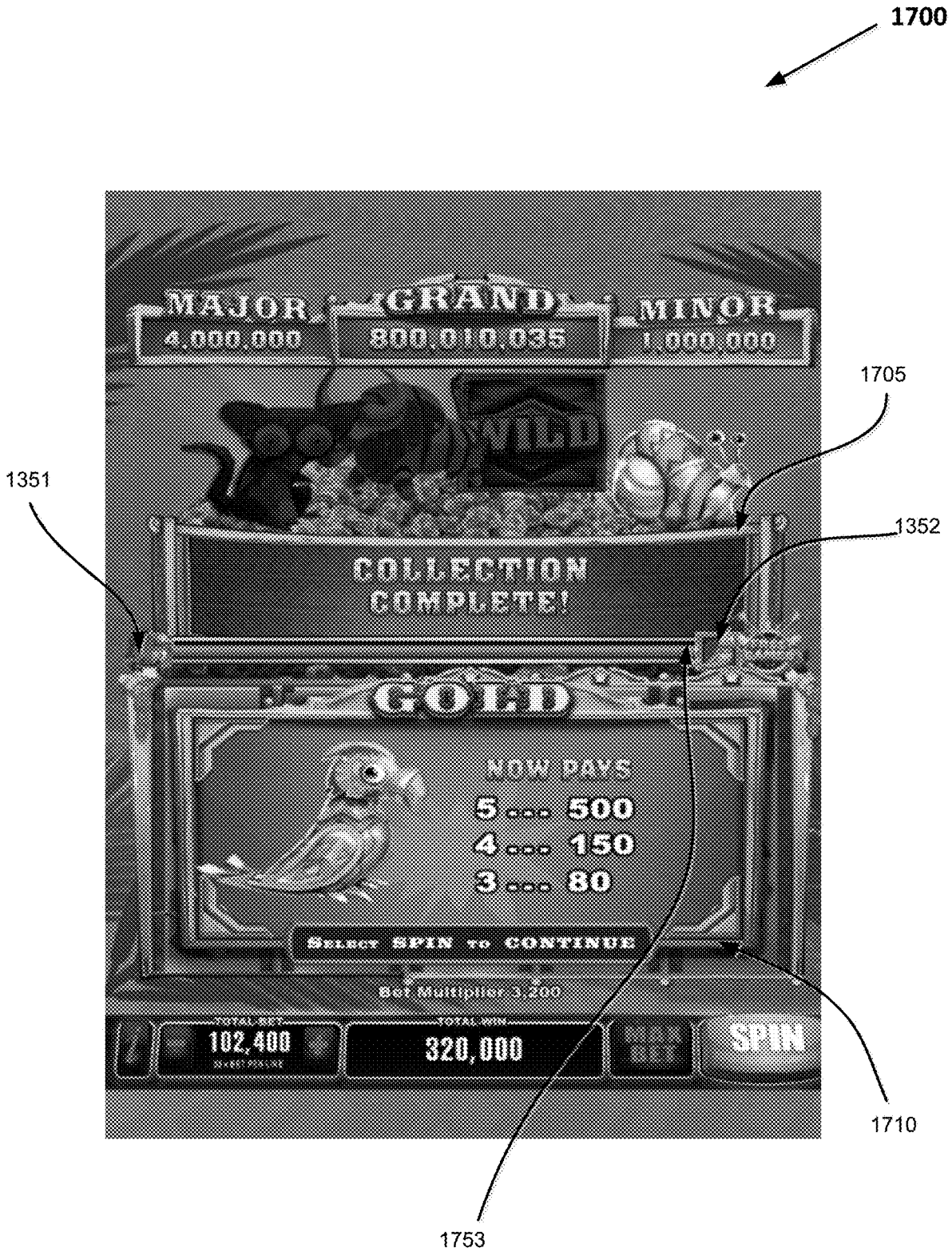

FIG. 17 shows the progress bar 1753 has reached the gold Parrot symbol 1352 and that a collection complete message 1705 is displayed together with a paytable update message 1710 that explains the effect of the completed collection of the target number of gold Parrot symbols on the paytable.

Figure 18:
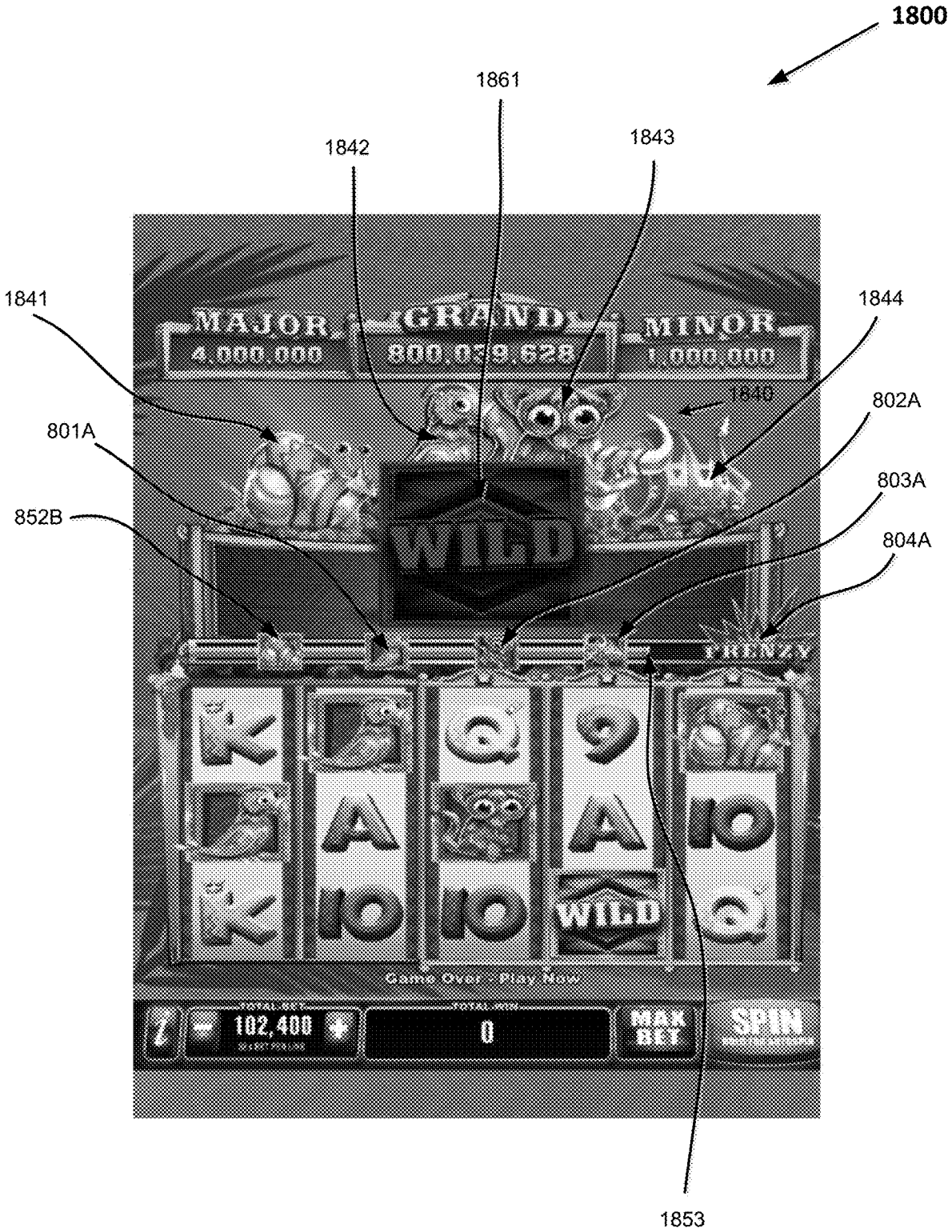

FIG. 18 is an example screen display 1800 of a game state when the player has completed collection of the target numbers of four collectable symbols. Accordingly, Snail symbol 1841, parrot symbol 1842, Lemur symbol 1843, and ox symbol 1844 are shown in a background display 1840 while WILD symbol 1861 is shown in the foreground as the last symbol to be collected. In this example, 200 WILD symbols need to be collected to trigger the "Frenzy" feature 804A. Progress bar 1853 shows the progress towards collecting all the WILD symbols. For example, as described herein, in at least some embodiments, the snail symbol is at an intermediate position 852B, similar to third position 652B.

Figure 19:
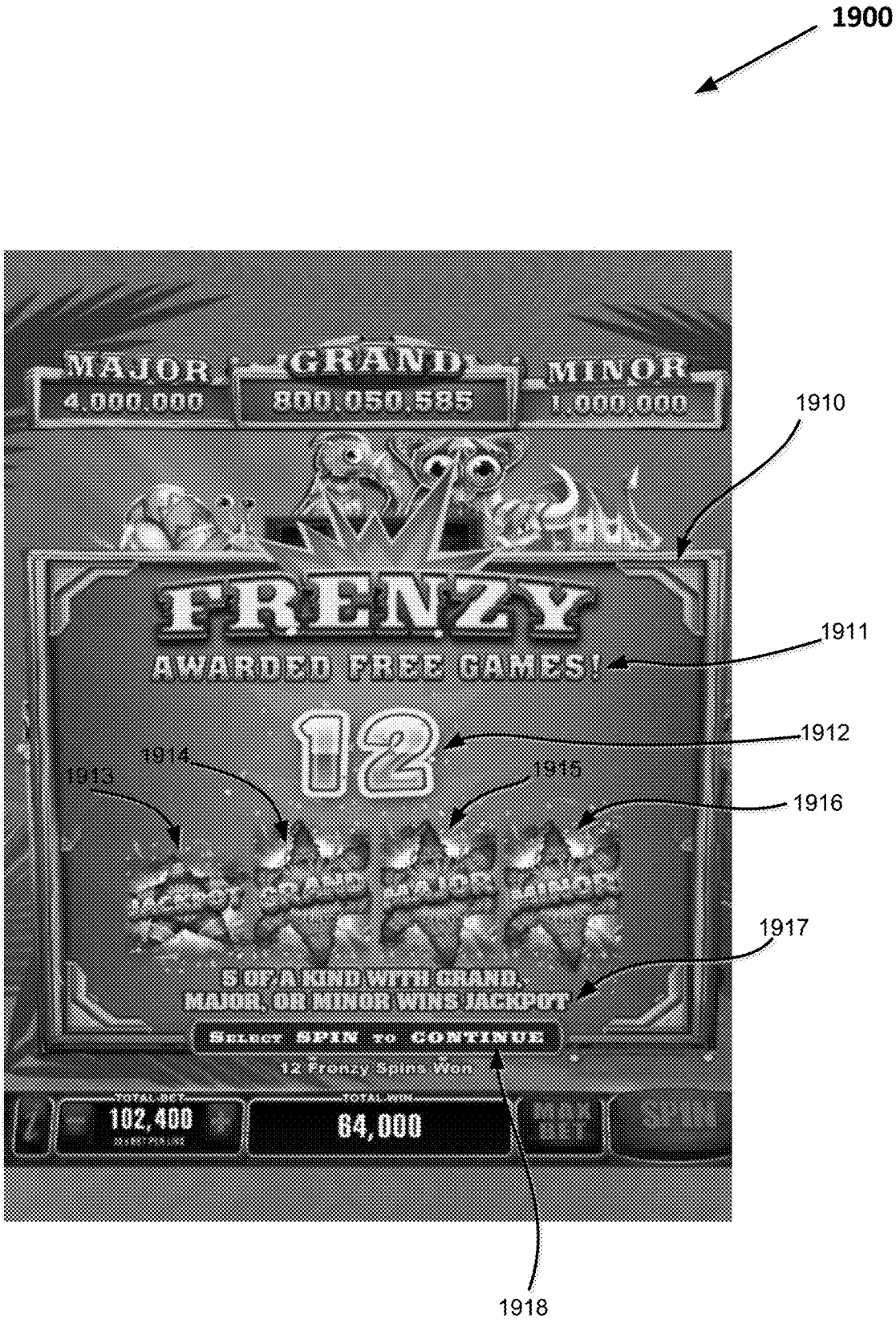
Figure 20:
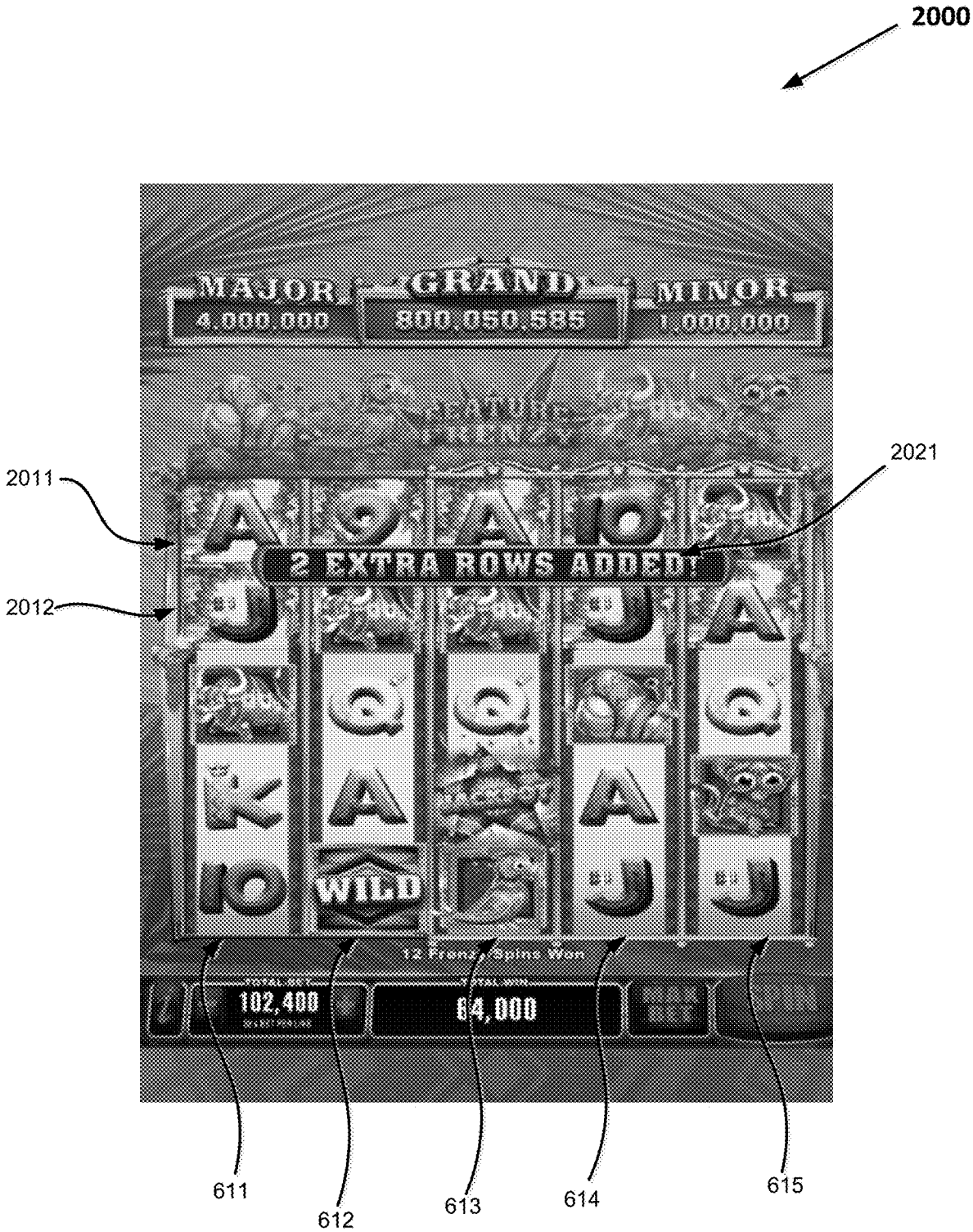

FIG. 19 is an example screen display 1900 with a message 1911 indicating that the Frenzy feature has been awarded. The Frenzy feature can be considered as being an enhanced free game feature where in this example, 12 free games are awarded as indicated by message 1912. A further message 1917 indicates that a player can win a Jackpot prize if the player has a five of a kind win featuring the Jackpot symbol 1913 in conjunction with the Grand symbol 1914, Major symbol 1915, or Minor symbol 1916. In at least some embodiments, a frenzy border 1910 may surround at least a portion of the frenzy feature. In some embodiments, a message 1918 may be displayed prompting the player to "Select SPIN to Continue."

As indicated above, the Frenzy feature can be considered an enhanced set of free games because in this example as indicated by message 2021 in the example screen display 2000 there are "two extra rows added!". That is, two rows 2011 and 2012 are added to the array of symbol positions such that each column of symbol positions 611-615 has two additional symbol positions.

Referring to FIGS. 5A and 5B, the enhanced free spin process 570 can be entered into in two manners in the embodiment. Either when the processor 204 determines at step 518 that the last collectable symbol has been collected or when the processor 204 determines at step 548 that the last collectable symbol has been collected. In the case of step 518, the processor 204 proceeds directly to step 570A whereas in the case of step 548 the processor 204 sets the enhanced free spins as triggered at step 544 such that after the processor 204 determines that no further free spins are set at step 560, the processor can determine at step 562 that enhanced free spins are set and proceed into the enhanced free spin process step 570B. If no enhanced free spins are set, in at least some embodiments, the process may terminate at step 590B.

The enhanced free spin process is shown in FIG. 5C and as described above, can be entered from steps 518 and 562. At step 572, the processor 204 controls the display 240 to transition to the enhanced free spin layout, i.e., the arrangement with two extra rows shown in FIG. 20. At step 574, the processor 204 sets the counter to an initial value, in this example, to 12 reflecting 12 free spins. At step 576, the processor 204 decreases the counter by 1 then proceeds to step 578 to select symbols in the manner described in relation to FIGS. 3 and 4. The processor 204 evaluates the selected symbols at step 580 using a process similar to that described above. However, it will be apparent that at this stage all the pays are upgraded such that amounts won for any winning combinations will be greater than in all previous games. The process of evaluating the symbols at step 580 also involves determining whether a Jackpot prize has been won for a combination of five Jackpot symbols including one of Grand, Major, or Minor jackpot symbols being selected. At step 582, the processor determines whether the counter has reached "0" and if not, reverts to step 576.

In an alternative to the above, rather than setting a counter at step 574, the processor could set a timer defining a defined time during which free spins would be conducted. In this example, rather than determining whether the counter=0 at step 582, the processor determines whether the timer is 0. There may be certain actions such as the award of a Jackpot which results in the timer being paused.

After the counter reaches 0 at step 584, the processor changes the game state data. In some examples, changing the game state data at step 584 will involve a complete reset of the game data such that the player begins by collecting the Snail symbol (the first collectable symbol) again. In other examples, the data may only be partially reset. After changing the game state data, the processor may terminate, in at least some embodiments, in step 590C.

In this respect, Table 1 illustrates an order of game states in which symbols are collected and free spins are conducted. This order defines five "rounds" of symbol collection play. The first six items in the order form the first round and correspond to the first time the collectable symbols are collected. At the end of the fifth round as indicated at order number 24, the processor 204 reverts to the twentieth item in the order, and, in effect, repeats the fifth round. These rounds reflect a number of different symbol collection states with different target symbols for collection and different numbers of symbols to be collected. That is, in a first round in the first state as indicated by the first entry in Table 1, the player collects the Pic 4 symbol (in this example, Snail symbol) and has to collect 500 symbols. Following completed collection of that symbol, the player is still in the first round and is in the second state where collection of the Pic 4 symbol has been completed and upgraded pays are being made for wins featuring the Pic 4 symbol and the Pic 3 symbol will be collected until the player collects 500 symbols. It will be apparent that at the sixth stage in the order as described above, the Frenzy or enhanced free spins are conducted for a number of 20 free spins in this instance.

The processor 204 then proceeds to order number 7 and is now conducting round two but initiates round with the symbol collection state in state 2, i.e., it treats the Pic 4 symbols as already collected. That is, processor 204 changes the game state data to reflect the current order position. For example, after completion of the first round, the processor 204 sets Pic 4 as collected and sets 700 as the threshold number of Pic 3 to be collected.

After completion of the second round, the processor 204 changes the game state differently at step 584 to set the initial game state for round 3 as being state 3 with 550 Pic 2 symbols requiring collection and the Pic 3 and Pic 4 symbols as upgraded. In round 4, the processor 204 also sets the game state to state 3 with the Pic 3 and Pic 4 symbols upgraded but with 700 Pic 2 symbols to be collected. In round 5, processor 204 sets game state to state 3 with Pic 3 and Pic 4 set as collected but requiring 830 spins to proceed to the next level. It will also be appreciated that at the conclusion of round 4, 25 free spins are conducted and at the conclusion of round 5, 30 spins are conducted.

TABLE 1

| Order | ROUND | STATE | COLLECT | HOW MANY |
|---|---|---|---|---|
| 1 | 1 | 1 | PIC4 | 500 |
| 2 | 1 | 2 | PIC3 | 500 |
| 3 | 1 | 3 | PIC2 | 500 |
| 4 | 1 | 4 | PIC1 | 500 |
| 5 | 1 | 5 | WILD | 200 |
| 6 | 1 | FRENZY | — | 20 spins |
| 7 | 2 | 2 | PIC3 | 700 |
| 8 | 2 | 3 | PIC2 | 550 |
| 9 | 2 | 4 | PIC1 | 550 |
| 10 | 2 | 5 | WILD | 225 |
| 11 | 2 | FRENZY | — | 20 spins |
| 12 | 3 | 3 | PIC2 | 550 |
| 13 | 3 | 4 | PIC1 | 700 |
| 14 | 3 | 5 | WILD | 280 |
| 15 | 3 | FRENZY | — | 20 spins |
| 16 | 4 | 3 | PIC2 | 700 |
| 17 | 4 | 4 | PIC1 | 840 |
| 18 | 4 | 5 | WILD | 340 |
| 19 | 4 | FRENZY | — | 25 spins |
| 20 | 5 | 3 | PIC2 | 830 |
| 21 | 5 | 4 | PIC1 | 840 |
| 22 | 5 | 5 | WILD | 450 |
| 23 | 5 | FRENZY | — | 30 spins |
| 24 | | Go to order 20 | | |

Approaches described herein facilitate a variety of technical improvements, such as improvements to the functioning of the EGMs described herein. In at least some embodiments, technical improvements include providing a new user interface that facilitates a plurality of consecutive rounds or stages of feature gameplay. Each consecutive round of feature play may be unlocked or otherwise made available following completion of a previous round (e.g., the Snail, Parrot, Lemur, Ox, and Wild or Frenzy rounds). Further, one or more upgraded paytables may be applied to each of the consecutive rounds of feature play. As a result of the new user interface and upgraded paytables, player understandability of the wagering game may be improved, particularly as successive rounds of feature play are unlocked and provided.

Further, in some embodiments, one or more hardware and/or software improvements may also be embodied by the systems and methods of the present disclosure. For example, the electronic gaming devices and systems of the present disclosure may include state-based logic and state based systems. In these state-based embodiments, current game state (e.g., that a player has collected all of a particular target symbol, such as all of the Snail symbol) may be stored in non-volatile memory (e.g., NVRAM) on an EGM 104A-104X, and which can be implemented using battery-backed RAM, flash memory, a solid-state drive, or other persistent memory.

To facilitate these and other operations, one or more functions of a game (e.g., bet, play, result, points in the graphical presentation, target symbols collected, progress through one or more feature games, etc.) may be defined as state variables. When a game moves from one state to another (e.g., from collection of Snail target symbols to collection of Parrot target symbols), data regarding the game state is stored in a custom non-volatile memory subsystem. In some cases, the gaming device does not advance from a current state to a subsequent state until information that allows the current state to be reconstructed is stored. In the event of a power failure or other malfunction, the gaming device will return to its current state when the power is restored by recovering state information from non-volatile memory. The restored state may include metering information and graphical information that was displayed on the gaming device in the state prior to the malfunction.

For example, if the player had unlocked a second feature game, such as the Parrot feature game, prior to interruption of the game, the game may be restored to a state in which the Parrot feature game is still unlocked. Likewise, if a player was shown an award for a game of chance and, before the award could be provided to the player, the power failed, the gaming device, upon the restoration of power, would return to the state where the award is indicated. More generally, the gaming device records, in non-volatile memory, the values of game parameters assigned during play, such as variables determined by an RNG or internal counters. (A game parameter, in general, can be one or more variables whose values govern play at the gaming device and depend on a random selection process.) The value of a game parameter can be recorded periodically, in response to some event such as user input, or whenever the value of the game parameter changes. This way, the gaming device can recover its state in case of a power failure or another destabilizing event, allowing the gaming device to reconstruct events that have taken place before the event. This requirement affects the software and hardware design on a gaming device. Game history information regarding previous games played, such as an amount wagered, the outcome of the game and so forth, may also be stored in a non-volatile memory device.

EXAMPLE EMBODIMENTS

An example embodiment provides a gaming device comprising:

a display;

a processor; and a memory storing (a) reel data defining a first plurality of reel strips, the reel strips comprising a first plurality of symbols including a first collectable symbol and a second plurality of reel strips comprising a second plurality of symbols including an upgraded first collectable symbol, (b) award data defining winning combinations and awards for each winning combination of symbols, wherein the award data defines (i) at least one winning combination featuring the first collectable symbol and base awards for the, or each, winning combination featuring the first collectable symbol, and (ii) at least one winning combination featuring the upgraded first collectable symbol and upgraded awards for the, or each, winning combination featuring the upgraded first collectable symbol (c) current game state data comprising data indicative of whether collection of instances of the first collectable symbol in prior game play has reached a threshold and, at least where the threshold has not been reached, a current number of collected instances of the first collectable symbol, and (d) instructions, wherein when the instructions are executed by the processor, they cause the processor to:

receive a player selection of a plurality of available player selections;

generate a game outcome by selecting symbols from the first plurality of reel strips responsive to receipt of the player selection when the threshold has not been reached, by selecting symbols from the second plurality of reel strips when the threshold has been reached, and controlling the display to display the selected symbols in a plurality of columns of symbol positions;

update the current game state data to reflect any instances of the first collectable symbols in the selected symbols that satisfies a collection condition;

evaluate the game outcome for winning combinations of symbols; and make one or more awards upon the game outcome including one or more winning combinations including by, upon the one or more winning combinations comprising a respective winning combination featuring the first collectable symbol, making the base award and upon the one or more winning combinations comprising a respective winning combination featuring the upgraded first collectable symbol, making the upgraded award.

Another example embodiment provides a method of operating a gaming device comprising a display, and a memory storing (a) reel data defining a first plurality of reel strips, the reel strips comprising a first plurality of symbols including a first collectable symbol and a second plurality of reel strips comprising a second plurality of symbols including an upgraded first collectable symbol, (b) award data defining winning combinations and awards for each winning combination of symbols, wherein the award data defines (i) at least one winning combination featuring the first collectable symbol and base awards for the, or each, winning combination featuring the first collectable symbol, and (ii) at least one winning combination featuring the upgraded first collectable symbol and upgraded awards for the, or each, winning combination featuring the upgraded first collectable symbol, and (c) current game state data comprising data indicative of whether collection of instances of the first collectable symbol in prior game play has reached a threshold and, at least where the threshold has not been reached, a current number of collected instances of the first collectable symbol, the method comprising:

receiving a player selection of a plurality of available player selections;

generating a game outcome by selecting symbols from the first plurality of reel strips responsive to receipt of the player selection when the threshold has not been reached, by selecting symbols from the second plurality of reel strips when the threshold has been reached, and controlling the display to display the selected symbols in a plurality of columns of symbol positions;

updating the current game state data to reflect any first collectable symbols in the selected symbols that satisfies a collection condition;

evaluating the game outcome for winning combinations of symbols; and making one or more awards upon the game outcome including one or more winning combinations including by, upon the one or more winning combinations comprising a respective winning combination featuring the first collectable symbol, making the base award and upon the one or more winning combinations comprising a respective winning combination featuring the upgraded first collectable symbol, making the upgraded award.

Another example embodiment provides a system comprising:

one or more processors; and a memory storing (a) reel data defining a first plurality of reel strips, the reel strips comprising a first plurality of symbols including a first collectable symbol and a second plurality of reel strips comprising a second plurality of symbols including an upgraded first collectable symbol, (b) award data defining winning combinations and awards for each winning combination of symbols, wherein the award data defines (i) at least one winning combination featuring the first collectable symbol and base awards for the, or each, winning combination featuring the first collectable symbol, and (ii) at least one winning combination featuring the upgraded first collectable symbol and upgraded awards for the, or each, winning combination featuring the upgraded first collectable symbol (c) current game state data comprising data indicative of whether collection of instances of the first collectable symbol in prior game play has reached a threshold and, at least where the threshold has not been reached, a current number of collected instances of the first collectable symbol, and (d) instructions, wherein when the instructions are executed by the one or more processors, they cause the one or more processors to:

receive a player selection of a plurality of available player selections;

generate a game outcome by selecting symbols from the first plurality of reel strips responsive to receipt of the player selection when the threshold has not been reached and by selecting symbols from the second plurality of reel strips when the threshold has been reached;

update the current game state data to reflect any first collectable symbols in the selected symbols that satisfies a collection condition;

evaluate the game outcome for winning combinations of symbols; and make one or more awards upon the game outcome including one or more winning combinations including by, upon the one or more winning combinations comprising a respective winning combination featuring the first collectable symbol, making the base award and upon the one or more winning combinations comprising a respective winning combination featuring the upgraded first collectable symbol, making the upgraded award.

While the disclosure has been described with respect to the figures, it will be appreciated that many modifications and changes may be made by those skilled in the art without departing from the spirit of the disclosure. Any variation and derivation from the above description and figures are included in the scope of the present disclosure as defined by the claims

What is claimed is:

1. An electronic gaming system comprising:

a display device;

an input device;

a memory; and at least one processor, wherein instructions stored in the memory, when executed by the at least one processor, cause the at least one processor to at least:

control the display device to display a game session of a game in response to an input received from a player of the game;

receive, from the input device, data representing at least one column identified by a user of a matrix of symbol positions, the matrix including a plurality of rows of symbol positions and a plurality of columns of symbol positions that includes the at least one column;

control the display device to display a plurality of symbols in the matrix of symbol positions, wherein at least one symbol displayed in the at least one column is a first collectable symbol associated with a first paytable;

increment a first collectable symbol counter stored in the memory in response to the first collectable symbol being displayed in the at least one column, wherein only user identified columns from the data received from the input device contribute to incrementing the first collectable symbol counter; and in response to the first collectable symbol counter reaching a threshold number during the game session, at least:

i) control the display device to display a first plurality of free games, each free game associated with a combination of symbols defining a free game outcome, and ii) retrieve an upgraded paytable from the memory for evaluation of each game outcome of the first plurality of free games, the upgraded paytable defining at least one upgraded award for at least one winning symbol combination that includes the first collectable symbol, the at least one upgraded award being greater than a base game award defined by the first paytable for the same at least one winning symbol combination.

2. The electronic gaming system of claim 1, wherein the instructions, when executed, further cause the at least one processor to at least:

control the display device to display at least one upgraded instance of the first collectable symbol during the first plurality of free games, the upgraded instance of the first collectable symbol different from instances of the first collectable symbol displayed during accumulation of the first collectable symbol.

3. The electronic gaming system of claim 1, wherein the instructions, when executed, further cause the at least one processor to at least:

following evaluation of each free game outcome of the first plurality of free games, control the display device to display a subsequent plurality of symbols in the matrix of symbol positions;

determine whether at least one symbol displayed in the matrix is an instance of a second collectable symbol, the second collectable symbol different from the first collectable symbol; and in response to the instance of the second collectable symbol being displayed in the matrix, determine whether a threshold number of instances of the second collectable symbol have been accumulated by the player during the game session, and if the threshold number of instances have not been accumulated, control the display device to display one or more subsequent pluralities of symbols in the matrix of symbol positions, whereby additional instances of the second collectable symbol are capable of being accumulated.

4. The electronic gaming system of claim 3, wherein the instructions, when executed, further cause the at least one processor to at least:

in response to the threshold number of instances being accumulated, award a second plurality of free games, and evaluate each free game outcome of the second plurality of free games using at least one of the upgraded paytable or one of a plurality of different upgraded paytables.

5. The electronic gaming system of claim 4, wherein the instructions, when executed, further cause the at least one processor to at least:

add at least one row of symbol positions to the matrix of symbol positions, the at least one additional row remaining in the matrix of symbol positions for the duration of the second plurality of free games and increasing the chances that one or more upgraded awards will be provided to the player.

6. The electronic gaming system of claim 4, wherein the instructions, when executed, further cause the at least one processor to at least:

control the display device to display a progress bar, the progress bar indicating at least that the player has accumulated the threshold number of instances of the first collectable symbol and the threshold number of instances of the second collectable symbol, and showing a current progress towards accumulating a threshold number of instances of a third collectable symbol, the third collectable symbol different from both of the first collectable symbol and the second collectable symbol.

7. The electronic gaming system of claim 4, wherein the instructions, when executed, further cause the at least one processor to at least:

following evaluation of each free game outcome of the subsequent plurality of free games, control the display device to display a further subsequent plurality of symbols in the matrix of symbol positions;

determine whether at least one symbol displayed in the matrix is an instance of a third collectable symbol, the third collectable symbol different from the first collectable symbol and the second collectable symbol;

in response to the instance of the third collectable symbol being displayed in the matrix, determine whether a threshold number of instances of the third collectable symbol have been accumulated by the player during the game session; and in response to the threshold number of instances being accumulated, award a third plurality of free games, and evaluate each free game outcome of the third plurality of free games using at least one of the upgraded paytable or one of the plurality of different upgraded paytables.

8. The electronic gaming system of claim 7, wherein the instructions, when executed, further cause the at least one processor to at least:

prior to awarding the third plurality of free games and during accumulation of the threshold number of instances of the third collectable symbol, control the display device to display a progress bar, the progress bar indicating a current progress towards accumulating the threshold number of instances of the third collectable symbol.

9. The electronic gaming system of claim 8, wherein the instructions, when executed, further cause the at least one processor to at least:

add at least one row of symbol positions to the matrix of symbol positions, the at least one additional row remaining in the matrix of symbol positions for the duration of the third plurality of free games and increasing the chances that one or more upgraded awards will be provided to the player.

10. The electronic gaming system of claim 7, wherein the instructions, when executed, further cause the at least one processor to at least:

following evaluation of each free game outcome of the further subsequent plurality of free games, control the display device to display an additional plurality of symbols in the matrix of symbol positions;

determine whether at least one symbol displayed in the matrix is an instance of a fourth collectable symbol, the fourth collectable symbol different from the first collectable symbol, the second collectable symbol, and the third collectable symbol; and in response to the instance of the fourth collectable symbol being displayed in the matrix, determine whether a threshold number of instances of the fourth collectable symbol have been accumulated by the player during the game session, if the threshold number of instances have not been accumulated, control the display device to continue display of one or more additional pluralities of symbols in the matrix of symbol positions, whereby additional instances of the fourth collectable symbol are capable of being accumulated.

11. The electronic gaming system of claim 10, wherein the instructions, when executed, further cause the at least one processor to at least:

in response to the threshold number of instances being accumulated, award a fourth plurality of free games, and evaluate each free game outcome of the fourth plurality of free games using at least one of the upgraded paytable or one of the plurality of different upgraded paytables.

12. The electronic gaming system of claim 11, wherein the instructions, when executed, further cause the at least one processor to at least:

add at least two rows of symbol positions to the matrix of symbol positions, the at least two additional rows remaining in the matrix of symbol positions for the duration of the fourth plurality of free games and increasing the chances that one or more upgraded awards will be provided to the player.

13. The electronic gaming system of claim 1, wherein the instructions, when executed, further cause the at least one processor to at least:

add at least one column of symbol positions or at least one row of symbol positions to the matrix of symbol positions, the at least one additional column or row remaining in the matrix of symbol positions for the duration of the first plurality of free games and increasing the chances that one or more upgraded awards will be provided to the player.

14. The electronic gaming system of claim 1, wherein the instructions, when executed, further cause the at least one processor to at least:

control the display device to display a plurality of collectable symbols including the first collectable symbol; and control the display device to display each collectable symbol of the plurality of collectable symbols in one of an active status or an inactive status, the active status indicating that a collectable symbol is currently accumulating, the inactive status indicating either that the player has previously accumulated a sufficient number of instances of a given collectable symbol or that the player has yet to begin accumulating instances of the given collectable symbol.

15. The electronic gaming system of claim 1, wherein the instructions, when executed, further cause the at least one processor to at least: store, in the memory, at least: (a) reel data defining a plurality of reel strips, the reel strips comprising the plurality of symbols including the first collectable symbol, (b) award data defining winning combinations and awards for each of a plurality of winning combination of symbols, wherein the award data defines at least one winning combination including the first collectable symbol and base and upgraded awards for the at least one winning combination, the base award included in the first paytable, the upgraded award included in the upgraded paytable, and (c) current game state data comprising data indicative of whether accumulated instances of the first collectable symbol in prior game play have reached the threshold number of instances and, at least where the threshold number of instances has not been reached, a current number of accumulated instances of the first collectable symbol.

16. An electronic gaming system comprising:

a display device;

a memory; and at least one processor, wherein instructions stored in the memory, when executed by the at least one processor, cause the at least one processor to at least:

control the display device to display a game session of a game in response to an input received from a player of the game;

control the display device to display a plurality of symbols in a matrix of symbol positions, the matrix including a plurality of rows of symbol positions and a plurality of columns of symbol positions;

increment a first collectable symbol counter in response to at least one symbol displayed in the matrix being an instance of a first collectable symbol associated with a first paytable;

in response to the first collectable symbol counter reaching a threshold number of instances being accumulated during the game session, at least:

i) control the display device to display a first plurality of free games, each free game associated with a combination of symbols defining a free game outcome, and ii) retrieve an upgraded paytable from the memory for evaluation of each game outcome of the first plurality of free games, the upgraded paytable defining at least one upgraded award for at least one winning symbol combination that includes the first collectable symbol, the at least one upgraded award being greater than a base game award defined by the first paytable for the same at least one winning symbol combination;

store, in the memory, at least: (a) reel data defining a plurality of reel strips, the reel strips comprising the plurality of symbols including the first collectable symbol, (b) award data defining winning combinations and awards for each of a plurality of winning combination of symbols, wherein the award data defines at least one winning combination including the first collectable symbol and base and upgraded awards for the at least one winning combination, the base award included in the first paytable, the upgraded award included in the upgraded paytable, and (c) current game state data comprising data indicative of whether accumulated instances of the first collectable symbol in prior game play have reached the threshold number of instances and, at least where the threshold number of instances has not been reached, a current number of accumulated instances of the first collectable symbol represented by the first collectable symbol counter;

generate a game outcome by selecting the plurality of symbols from the plurality of reel strips; and update the current game state data to reflect any instances of the first collectable symbol in the selected plurality of symbols that satisfy a collection condition, wherein the collection condition is that the instances of the first collectable symbol are positioned in one or more columns of the matrix associated with data received from an input device, the data representing the one or more columns identified by a user.

17. The electronic gaming system of claim 16, wherein the instructions, when executed, further cause the at least one processor to at least:

store, in the memory, an order of the first collectable symbol and one or more further collectable symbols from a plurality of collectable symbols; and enable collection of a next collectable symbol from the order, the next collectable symbol different from the first collectable symbol, only after the threshold number of instances of the first collectable symbol being accumulated.

18. The electronic gaming system of claim 17, wherein the instructions, when executed, further cause the at least one processor to at least:

at least in response to the threshold number of instances of the first collectable symbol being accumulated, change the game state data, such that the upgraded award associated with the at least one winning symbol combination that includes the first collectable symbol does not apply, in at least some subsequent rounds of free play, to symbol combinations including the first collectable symbol.

19. The electronic gaming system of claim 18, wherein the instructions, when executed, further cause the at least one processor to at least:

at least in response to the threshold number of instances of the first collectable symbol being accumulated, change the game state data, such that the order of the first collectable symbol and one or more further collectable symbols excludes the first collectable symbol, at least until all of the collectable symbols in the order have been accumulated.

20. A non-transitory computer readable medium containing instructions embodied thereon which, when executed by at least one processor, causes the at least one processor to:

control a display device to display a game session of a game in response to an input received from a player of the game;

receive, from an input device, data representing at least one column identified by a user of a matrix of symbol positions, the matrix including a plurality of rows of symbol positions and a plurality of columns of symbol positions that includes the at least one column;

control the display device to display a plurality of symbols in the matrix of symbol positions, wherein at least one symbol displayed in the at least one column is a first collectable symbol associated with a first paytable;

increment a first collectable symbol counter in response to the first collectable symbol being displayed in the at least one column, wherein only user identified columns from the data received from the input device contribute to incrementing the first collectable symbol counter; and in response to the first collectable symbol counter reaching a threshold number during the game session, at least:

i) control the display device to display a first plurality of free games, each free game associated with a combination of symbols defining a free game outcome, and ii) retrieve an upgraded paytable for evaluation of each game outcome of the first plurality of free games, the upgraded paytable defining at least one upgraded award for at least one winning symbol combination that includes the first collectable symbol, the at least one upgraded award being greater than a base game award defined by the first paytable for the same at least one winning symbol combination.

* * * * *